US012209835B2

(12) United States Patent
Chia

(10) Patent No.: US 12,209,835 B2
(45) Date of Patent: Jan. 28, 2025

(54) FEEDING MECHANISM AND METHOD FOR TOY PROJECTILE LAUNCHER

(71) Applicants: EASEBON SERVICES LIMITED, Hong Kong (CN); Francis See Chong Chia, Hong Kong (CN)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 18/021,290

(22) PCT Filed: May 5, 2021

(86) PCT No.: PCT/SG2021/050249

§ 371 (c)(1),
(2) Date: Feb. 14, 2023

(87) PCT Pub. No.: WO2022/039667

PCT Pub. Date: Feb. 24, 2022

(65) Prior Publication Data

US 2023/0296337 A1 Sep. 21, 2023

Related U.S. Application Data

(60) Provisional application No. 63/147,835, filed on Feb. 10, 2021, provisional application No. 63/066,389, filed on Aug. 17, 2020.

(51) Int. Cl.
*F41A 9/19* (2006.01)
*F41A 9/55* (2006.01)
(Continued)

(52) U.S. Cl.
CPC *F41A 9/19* (2013.01); *F41A 9/55* (2013.01); *F41B 11/55* (2013.01); *F41B 11/89* (2013.01); *F41A 9/70* (2013.01)

(58) Field of Classification Search
CPC .. F41B 11/55; F41B 11/89; F41A 9/19; F41A 9/20; F41A 9/21; F41A 9/23
See application file for complete search history.

(56) References Cited

U.S. PATENT DOCUMENTS 2,758,403 A 8/1956 Hill
4,756,297 A 7/1988 Sindel
(Continued)

FOREIGN PATENT DOCUMENTS

CN 111389025 A 7/2020
CN 111389025 B 3/2022

OTHER PUBLICATIONS

International Preliminary Report on Patentability issued in PCT/SG2021/050249, mailed Aug. 3, 2021.

*Primary Examiner* — Bret Hayes
(74) *Attorney, Agent, or Firm* — Amster, Rothstein & Ebenstein LLP

(57) ABSTRACT

A toy launcher including a housing, a storage cartridge configured for placement into an opening of the housing, with projectiles within the storage cartridge held in a first orientation, a cocking slide movably attached to the housing between a first position and a second position, a reciprocating frame operatively connected to the cocking slide, a projectile housing pivotably attached to the toy launcher housing adjacent to the storage cartridge, and a reciprocating feed lever operatively connected to the reciprocating frame. Movement of the cocking slide from the first position to the second position in a first priming step and then back to the first position in a second priming step causes the feed lever to push a projectile from the storage cartridge into the projectile housing, pivots the projectile housing so that the projectile is in a second orientation, and places the projectile in the second orientation at a firing position within the toy launcher.

36 Claims, 15 Drawing Sheets

(51) Int. Cl.

| | |
|---|---|
| ***F41B 11/55*** | (2013.01) |
| ***F41B 11/89*** | (2013.01) |
| *F41A 9/70* | (2006.01) |

(56) References Cited

U.S. PATENT DOCUMENTS

| | | | | |
|---|---|---|---|---|
| 9,534,865 | B1 | 1/2017 | Clayton | |
| 10,852,098 | B1 * | 12/2020 | Wei | F41C 23/16 |
| 11,674,778 | B1 * | 6/2023 | Borter | F41A 9/41 124/73 |
| 2004/0025393 | A1 | 2/2004 | Reynolds | |
| 2011/0083653 | A1 | 4/2011 | Kawashima | |
| 2014/0165983 | A1 | 6/2014 | Busse et al. | |
| 2018/0202752 | A1 * | 7/2018 | Buys | F41B 11/55 |
| 2021/0095935 | A1 * | 4/2021 | Chia | F41B 11/54 |

* cited by examiner

100

FEEDING MECHANISM AND METHOD FOR TOY PROJECTILE LAUNCHER

RELATED APPLICATIONS

This application is a U.S. national phase filing of and claims priority to and the benefit of PCT Application No. PCT/SG2021/050249, filed May 5, 2021 and entitled FEEDING MECHANISM AND METHOD FOR TOY PROJECTILE LAUNCHER, which in turn claims priority to and the benefit of U.S. Provisional Application No. 63/066,389, filed Aug. 17, 2020 and entitled FEEDING MECHANISM AND METHOD FOR TOY PROJECTILE LAUNCHER, and U.S. Provisional Application No. 63/147,835, filed Feb. 10, 2021 and entitled FEEDING MECHANISM AND METHOD FOR TOY PROJECTILE LAUNCHER. The contents of these applications are incorporated herein by reference in their entirety.

FIELD

The present invention is generally related to a toy projectile launcher, such as a toy pistol, gun, and the like, for launching toy projectiles, such as foam bullets, darts, balls, and the like, with a projectile feeding mechanism for reducing the size of the projectile launcher.

BACKGROUND

Traditional toy projectile launchers have utilized various forms of rifles, pistols, blasters, machine guns, and the like, for launching toy projectiles, such as foam balls, darts, to name a few. Such toy launchers have varied in size, power, storage capacity, to name a few. More specifically, toy launchers of foam projectiles—bullets (or "darts"), balls, and the like— have become ubiquitous. One standard for foam bullets has been marketed under the brand name Nerf® with a rubber tip and a foam body that totals approximately 71.5 mm in length. There have been various types of rifles, machine guns, and the like, that have been marketed for launching such foam projectiles. In most cases, the launchers for these standard Nerf® foam bullets have been large rifle-style launchers that can be inflexible and unwieldy during play. In a manner similar to conventional bullets in an automatic or semi-automatic rifle (e.g., sub-machine gun and the like), standard elongate foam darts need to be housed in an external body that can guide each dart, with the tip pointing forward, sequentially into a firing chamber. In other words, elongate foam darts cannot be jumbled up in a hopper—for example, in the manner that polyurethane (PU) foam balls or paint balls often are in their respective launchers. A storage housing for elongate darts can be in the form of a cartridge belt, a magazine clip, a drum, or a cylinder barrel. In all cases, the heavier tip of the foam dart needs to be pointing forward to satisfy flight requirements.

A magazine clip is the most commonly used storage housing for standard elongate foam darts. In a manner similar to conventional magazine clip used for a standard rifle or a sub-machine gun, a foam dart magazine clip is usually inserted into the underside of a blaster body. Magazine clips may also be inserted sideways into the blaster body, or down into the top of the blaster. In all of these alternative configurations, the magazine clip would protrude out from the blaster. While a "sub-machine gun" foam dart launcher may be designed to be aesthetically pleasing, whether in a realistic or futuristic mode, a protruding magazine clip limits the design scope to just conventional sub-machine gun designs, or their variations.

Accordingly, there has been a need for a more portable foam or plastic toy projectile launcher that provides for more flexible play without sacrificing launch velocity and accuracy yet providing for increased projectile capacity.

SUMMARY

To address the above, the present invention is generally related to an improved toy launcher for launching a foam dart with a feeding mechanism from a storage cartridge to a firing position that reduces the overall size of the launcher.

In particular, the present invention is directed to a dart feeding mechanism that provides for hiding a foam dart magazine clip inside the housing body of a blaster, which then allows the blaster body to take any shape—for example, as a shotgun—which might otherwise look extremely unattractive or unrealistic with a protruding magazine clip. In embodiments, the feeding mechanism is compatible with a standard foam dart magazine clip—for example, magazine clips used for Nerf® launchers and the like. The magazine clip has a long body to hold the foam darts, wherein the length is directly related to the capacity of the magazine clip for holding a number of darts.

In embodiments, for an increased capacity of a magazine clip that, nevertheless, does not protrude significantly from a housing of a launcher, the launcher provides for inserting the magazine clip into the main body via the rear of the launcher. In embodiments, the magazine clip may also be inserted via an opening on the front of the launcher. For such magazine clip insertion configurations, the foam darts stored in the magazine clip would be aligned in a direction that is orthogonal to the launch direction of the launcher—in other words, the stored foam darts would be either pointing upwards or pointing downwards when the magazine clip is inserted into the launcher—depending upon whether the clip is inserted above or below the launch assembly.

According to an exemplary embodiment of the present invention, a feeding mechanism is incorporated within the housing of the launcher that reorients a stored foam dart into a firing direction, thereby eliminating the need for the stored foam dart—e.g., in an insertable cartridge and the like—to be originally oriented in the firing direction, which then would negate the need for the foam dart storage compartment to extend in a direction that is orthogonal to the firing direction. Advantageously, an effective, user-friendly, and high-performance blaster may be realized in a more compact design without sacrificing the ability to load a larger number of projectiles. Additionally, the present invention is directed to a toy launcher with a simple construction for an improved integrated launcher with a two-step loading/priming and firing mechanism that decreases the size of the launcher while realizing high launching force for projectiles and increased dart capacity.

According to an exemplary embodiment, the toy launcher incorporates a projectile feeding mechanism that reorients a first projectile in a storage area having a first orientation to a second orientation of a firing position.

In embodiments, the projectile feeding mechanism includes a lever configured to push the first projectile from the storage area towards a priming surface or into a projectile housing.

In embodiments, the lever is coupled to a sliding handle.

In embodiments, the lever includes an extendible and retractable tip section.

In embodiments, the toy launcher includes a coupling between the sliding handle and a barrel of an air piston assembly.

In embodiments, the barrel is movable to a backward position when the sliding handle is moved to the backward position.

In embodiments, a front portion of the barrel pushes the plunger element to compress the compression spring against the rear wall of the toy launcher when the sliding handle is moved to the backward position.

In embodiments, the projectile feeding mechanism advances the first projectile into a priming position in front of the barrel when the sliding handle is moved from the backward position to the forward position.

In embodiments, the lever of the projectile feeding mechanism is pivoted upward to push the first projectile towards the priming surface or into the projectile housing when the sliding handle is moved from the backward position to the forward position.

In embodiments, the priming surface is formed by a resilient flap that pushes the first projectile towards a forward orientation when the lever pushes the first projectile upward towards the priming surface.

In embodiments, the plunger element and the barrel form an internal air chamber when the sliding handle is moved from the backward position to the forward position.

In embodiments, the barrel pushes the loaded projectile in the priming position forward into the firing position inside a launch barrel.

In embodiments, the plunger element is pushed forward by the compression spring to expel the air from the internal air chamber through an air nozzle on a front end of the barrel behind the loaded projectile in the firing position when the coupling of the latching assembly between the plunger element and the trigger assembly is released.

In embodiments, in the firing position, the air nozzle on a front end of the air piston assembly is immediately adjacent the projectile which in turn is in the launching barrel.

In embodiments, the spring-loaded air piston assembly is substantially oval in cross-section to maximize volume of the internal air chamber without increasing the thickness or length of the toy launcher.

A toy launcher according to an exemplary embodiment of the present invention comprises: a housing; a storage cartridge configured for placement into an opening of the housing, with projectiles within the storage cartridge held in a first orientation; a cocking slide movably attached to the housing between a first position and a second position; a reciprocating frame operatively connected to the cocking slide; a projectile housing pivotably attached to the toy launcher housing adjacent to the storage cartridge; and a reciprocating feed lever operatively connected to the reciprocating frame, whereby movement of the cocking slide from the first position to the second position in a first priming step and then back to the first position in a second priming step causes the feed lever to push a projectile from the storage cartridge into the projectile housing, pivots the projectile housing so that the projectile is in a second orientation, and places the projectile in the second orientation at a firing position within the toy launcher.

According to an exemplary embodiment of the present invention, the operative connection between the feed lever and the reciprocating frame is configured so that the feed lever moves relative to the storage cartridge with a reciprocating movement of the reciprocating frame.

According to an exemplary embodiment of the present invention, the reciprocating feed lever comprises at least one first pin and at least one second pin disposed below the at least first pin, wherein the at least one second pin is fixed to the housing.

According to an exemplary embodiment of the present invention, the reciprocating frame comprises at least one first track and at least one second track disposed below the at least first track, wherein the at least one first pin of the reciprocating feed lever is slidably engaged within the at least first track of the reciprocating frame and the at least one second pin of the reciprocating feed lever is slidably engaged within the at least one second track of the reciprocating frame.

According to an exemplary embodiment of the present invention, the reciprocating feed lever comprises a retractable tip portion that is biased in an extended configuration.

According to an exemplary embodiment of the present invention, upon a condition the cocking slide is in the first position before the first priming step, the retractable tip portion is pushed into a retracted configuration by the projectile which is a front-most projectile stored in the storage cartridge.

According to an exemplary embodiment of the present invention, upon a condition the cocking slide is moved from the first position to the second position in the first priming step, the at least one first pin of the reciprocating lever is pushed backwards within the at least first track of the reciprocating frame so that the reciprocating lever is pivoted about the at least one second pin to a position below the storage cartridge, thereby releasing the retractable tip portion of the reciprocating lever into the extended configuration.

According to an exemplary embodiment of the present invention, upon the condition the cocking slide is moved from the second position to the first position in the second priming step, the at least one first pin of the reciprocating lever is pulled forward within the at least first track of the reciprocating frame so that the reciprocating lever is pivoted about the at least one second pin and the retractable tip portion in the extended configuration is pushed into engagement with the front-most projectile of the storage cartridge, thereby pushing the front-most projectile into the projectile housing.

According to an exemplary embodiment of the present invention, the storage cartridge is spring-loaded.

According to an exemplary embodiment of the present invention, the toy launcher further comprises a launch barrel.

According to an exemplary embodiment of the present invention, the first orientation of the projectiles is perpendicular to a longitudinal axis of the launch barrel.

According to an exemplary embodiment of the present invention, the second orientation of the projectiles is parallel to a longitudinal axis of the launch barrel.

According to an exemplary embodiment of the present invention,

According to an exemplary embodiment of the present invention, the toy launcher further comprises an air piston assembly, and the air piston assembly comprises: a barrel operatively connected to the cocking slide; a plunger element slidably disposed within the barrel; an air nozzle disposed at a front portion of the barrel; a push rod extending from the front portion of the barrel; and a compression spring that biases the plunger element within the barrel away from a back wall of the housing of the toy launcher.

According to an exemplary embodiment of the present invention, upon a condition in which the cocking slide is moved from the first position to the second position in the first priming step, the barrel pushes the plunger element backwards to compress the compression spring against the back wall.

According to an exemplary embodiment of the present invention, upon a condition in which the cocking slide is moved from the second position to the first position in the second priming step, the barrel is pulled forward while the plunger element is held in position by a coupling between the plunger element and the back wall, thereby pulling air through the air nozzle and into an internal air chamber formed by the plunger element and the barrel.

According to an exemplary embodiment of the present invention, upon a condition in which the cocking slide is moved from the second position to the first position in the second priming step, the push rod pushes against the projectile housing so that the projectile is pivoted into the second orientation.

According to an exemplary embodiment of the present invention, upon a condition in which the cocking slide is moved from the second position to the first position in the second priming step, the air nozzle protrudes into the projectile housing to push the projectile into the firing position.

According to an exemplary embodiment of the present invention, the toy launcher further comprises a trigger assembly.

According to an exemplary embodiment of the present invention, upon actuation of the trigger assembly after the second priming step, the coupling between the plunger element and the back wall is released so that the compression spring pushes the plunger element forward to expel the air from the internal air chamber through the air nozzle, thereby firing the projectile from the toy launcher.

According to an exemplary embodiment of the present invention, the air piston assembly is substantially oval in cross-section.

A toy launcher according to an exemplary embodiment of the present invention comprises: a housing; a storage cartridge configured for placement into an opening of the housing, with projectiles within the storage cartridge held in a first orientation; a cocking slide movably attached to the housing between a first position and a second position; a reciprocating frame operatively connected to the cocking slide; and a reciprocating feed lever operatively connected to the reciprocating frame, whereby movement of the cocking slide from the first position to the second position in a first priming step and then back to the first position in a second priming step causes the lever to push a projectile from the storage cartridge and into a second orientation, and places the projectile in the second orientation at a firing position within the toy launcher.

According to an exemplary embodiment of the present invention, the operative connection between the feed lever and the reciprocating frame is configured so that the feed lever moves relative to the storage cartridge with a reciprocating movement of the reciprocating frame.

According to an exemplary embodiment of the present invention, the reciprocating feed lever comprises at least one first pin and at least one second pin disposed below the at least first pin, wherein the at least one second pin is fixed to the housing.

According to an exemplary embodiment of the present invention, the reciprocating frame comprises at least one first track and at least one second track disposed below the at least first track, wherein the at least one first pin of the reciprocating feed lever is slidably engaged within the at least first track of the reciprocating frame and the at least one second pin of the reciprocating feed lever is slidably engaged within the at least one second track of the reciprocating frame.

According to an exemplary embodiment of the present invention, the reciprocating feed lever comprises a retractable tip portion that is biased in an extended configuration.

According to an exemplary embodiment of the present invention, upon a condition the cocking slide is in the first position before the first priming step, the retractable tip portion is pushed into a retracted configuration by the projectile which is a front-most projectile stored in the storage cartridge.

According to an exemplary embodiment of the present invention, upon a condition the cocking slide is moved from the first position to the second position in the first priming step, the at least one first pin of the reciprocating lever is pushed backwards within the at least first track of the reciprocating frame so that the reciprocating lever is pivoted about the at least one second pin to a position below the storage cartridge, thereby releasing the retractable tip portion of the reciprocating lever into the extended configuration.

According to an exemplary embodiment of the present invention, upon a condition the cocking slide is moved from the second position to the first position, the at least one first pin of the reciprocating lever is pulled forward within the at least first track of the reciprocating frame so that the reciprocating lever is pivoted about the at least one second pin and the retractable tip portion in the extended configuration is pushed into engagement with the front-most projectile of the storage cartridge, thereby pushing the front-most projectile from the storage cartridge and into the second orientation.

According to an exemplary embodiment of the present invention, the storage cartridge is spring-loaded.

According to an exemplary embodiment of the present invention, the toy launcher further comprises a launch barrel.

According to an exemplary embodiment of the present invention, the first orientation of the projectiles is perpendicular to a longitudinal axis of the launch barrel.

According to an exemplary embodiment of the present invention, the second orientation of the projectiles is parallel to a longitudinal axis of the launch barrel.

According to an exemplary embodiment of the present invention, the toy launcher further comprises a spring-loaded flap that pushes a tip portion of the front-most projectile downwards to pivot the front-most projectile into the second orientation while the reciprocating lever pushes the front-most projectile from the storage cartridge.

According to an exemplary embodiment of the present invention, the toy launcher further comprises an air piston assembly, and the air piston assembly comprises: a barrel operatively connected to the cocking slide by the reciprocating frame; a plunger element slidably disposed within the barrel; an air nozzle disposed at the front of the barrel; and a compression spring that biases the plunger element within the barrel away from a back wall of the housing of the toy launcher.

According to an exemplary embodiment of the present invention, upon a condition in which the cocking slide is moved from the first position to the second position in the first priming step, the barrel pushes the plunger element backwards to compress the compression spring against the back wall.

According to an exemplary embodiment of the present invention, upon a condition in which the cocking slide is moved from the second position to the first position in the second priming step, the barrel is pulled forward while the plunger element is held in position by a coupling between the plunger element and the back wall, thereby pulling air through the air nozzle and into an internal air chamber formed by the plunger element and the barrel.

According to an exemplary embodiment of the present invention, upon a condition in which the cocking slide is moved from the second position to the first position in the second priming step, the air nozzle pushes the projectile into the firing position.

According to an exemplary embodiment of the present invention, the toy launcher further comprises a trigger assembly.

According to an exemplary embodiment of the present invention, upon actuation of the trigger assembly after the second priming step, the coupling between the plunger element and the back wall is released so that the compression spring pushes the plunger element forward to expel the air from the internal air chamber through the air nozzle, thereby firing the projectile from the toy launcher.

According to an exemplary embodiment of the present invention, the air piston assembly is substantially oval in cross-section.

BRIEF DESCRIPTION OF THE DRAWINGS

Exemplary embodiments of the present disclosure will be described with references to the accompanying figures, wherein.

DETAILED DESCRIPTION

The present invention is generally related to an improved toy launcher with a feeding mechanism that reorients projectiles from a storage direction in a projectile storage area into a launching direction when primed for launch. To achieve this objective, according to an exemplary embodiment, a toy launcher incorporates a spring-loaded lever that is coupled to a projectile priming mechanism for concurrently priming the launcher and reorienting a projectile for launch. According to another exemplary embodiment, the projectile is pushed from the projectile storage area into an individual projectile housing, and then the projectile housing is pivoted into alignment with a firing position. The projectile housing achieves the objective of protecting the projectile from wear and fatigue during the launcher priming steps in which the projectile is reoriented into the firing position.

Figures 1A, 1B:
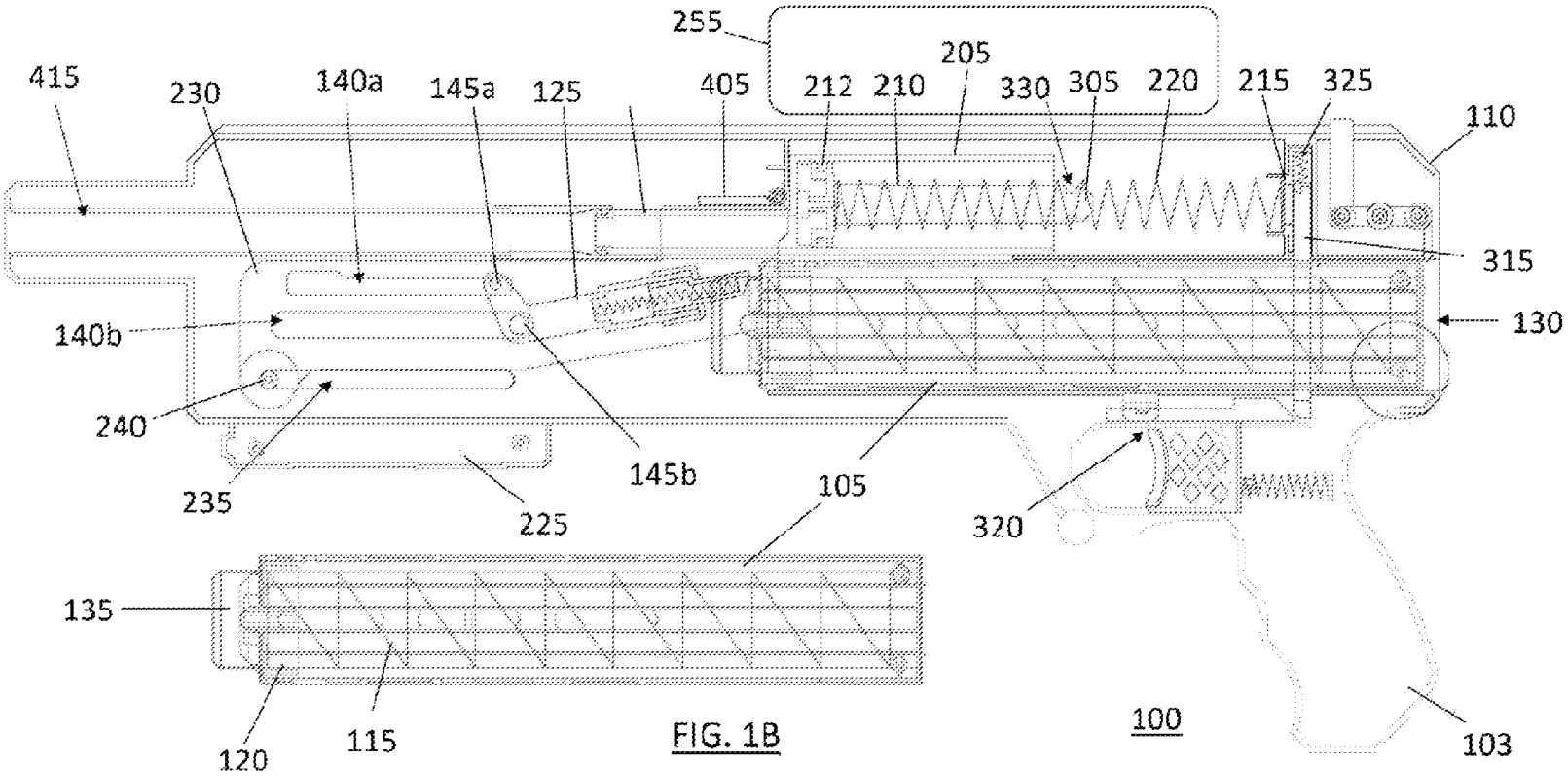
FIG. 1A is a schematic partial cross-sectional side view of key elements of a toy projectile launcher with an inserted empty cartridge according to an exemplary embodiment of the present disclosure.
FIG. 1B is a schematic cross-sectional view of the cartridge shown in FIG. 1A.

FIGS. 1A and 1B are schematic partial cross-sectional views of key elements of a toy projectile launcher 100 and an empty storage cartridge 105 configured for insertion into launcher 100, respectively, according to an exemplary embodiment of the present invention. For clarity and simplicity in illustrating the key elements and mechanisms of toy projectile launcher 100 and storage cartridge 105, portions that are not necessary to understand the scope and the spirit of the present disclosure are not shown. One of ordinary skill in the art would readily understand the supporting elements needed to house and support the various illustrated elements, including those that facilitate the insertion and removal of cartridge 105 into and out of launcher 100, with various design choices that would not depart from the spirit and scope of the present disclosure.

FIG. 1A is a schematic side cross-sectional view of a projectile launcher 100 in un-cocked position with an empty storage cartridge 105 inserted therein according to an exemplary embodiment of the present invention. As shown in FIG. 1A, projectile launcher 100 is shaped to resemble a short-barreled shotgun, with a handle 103 that is shaped to resemble a pistol grip in place of a full-length stock. In embodiments, launcher 100 may be in various other shapes and arrangements without departing from the spirit and the scope of the disclosure, as detailed below. As illustrated in FIG. 1A, a reciprocating air piston assembly 255 comprised of a barrel 205 and a plunger element 210 is located above the handle 103 and inserted cartridge 105 of the projectile launcher 100. According to an exemplary embodiment, the barrel 205 of air piston assembly 255 has a generally rounded cylindrical or an oval shape and plunger element 210 is biased away from back wall 215 of the rear part of launcher housing 110 by a compression spring 220. The plunger element 210 incorporates a size and a shape that correspond with an internal circumference of barrel 205 so as to form an airtight seal with an internal surface of barrel 205. According to an exemplary embodiment of the disclosure, plunger element 210 incorporates a resilient O-ring 212 (FIG. 1A) to form an improved seal. As shown in FIG. 1A, barrel 205 is coupled to a cocking slide 225 via a reciprocating frame 230 that is fittingly coupled to, along with cocking slide 225, a track 235 incorporated in the housing 110 of launcher 100. According to an exemplary embodiment of the present invention, reciprocating frame 230 incorporates a pin 240 that slides along track 235 when cocking slide 225 is cocked back and forth similar to a pump action shotgun, which, in turn, primes air piston assembly 255 while feeding a foam dart for launch, as will be described in further detail below. In embodiments, cocking slide 225 may be coupled to reciprocating frame 230 via pin 240 as well.

As shown in FIGS. 1A and 1B, cartridge 105 includes a loading compression spring 115 and a pusher block 120. When cartridge 105 is empty, as illustrated in FIGS. 1A and 1B, compression spring 115 is in an expanded state where a pusher block 120 is pushed upward (leftward in FIG. 1B), which is disposed proximate to a dart-feeding lever 125 when cartridge 105 is inserted into launcher 100, as shown in FIG. 1A. As described in further detail below, projectiles—such as foam darts/bullets and the like—would be advanced by spring 115 via block 120 such that a topmost projectile would be delivered to a position for feeding, by lever 125, into a firing position.

As further illustrated in FIG. 1B, block 120 is positioned proximate a top opening of cartridge 105 when cartridge 105 is empty. Additionally, cartridge 105 includes a frame 135, which includes two generally rounded stops for fitting around the outer surface on the two sides of a topmost dart stored in cartridge 105.

Figure 6:
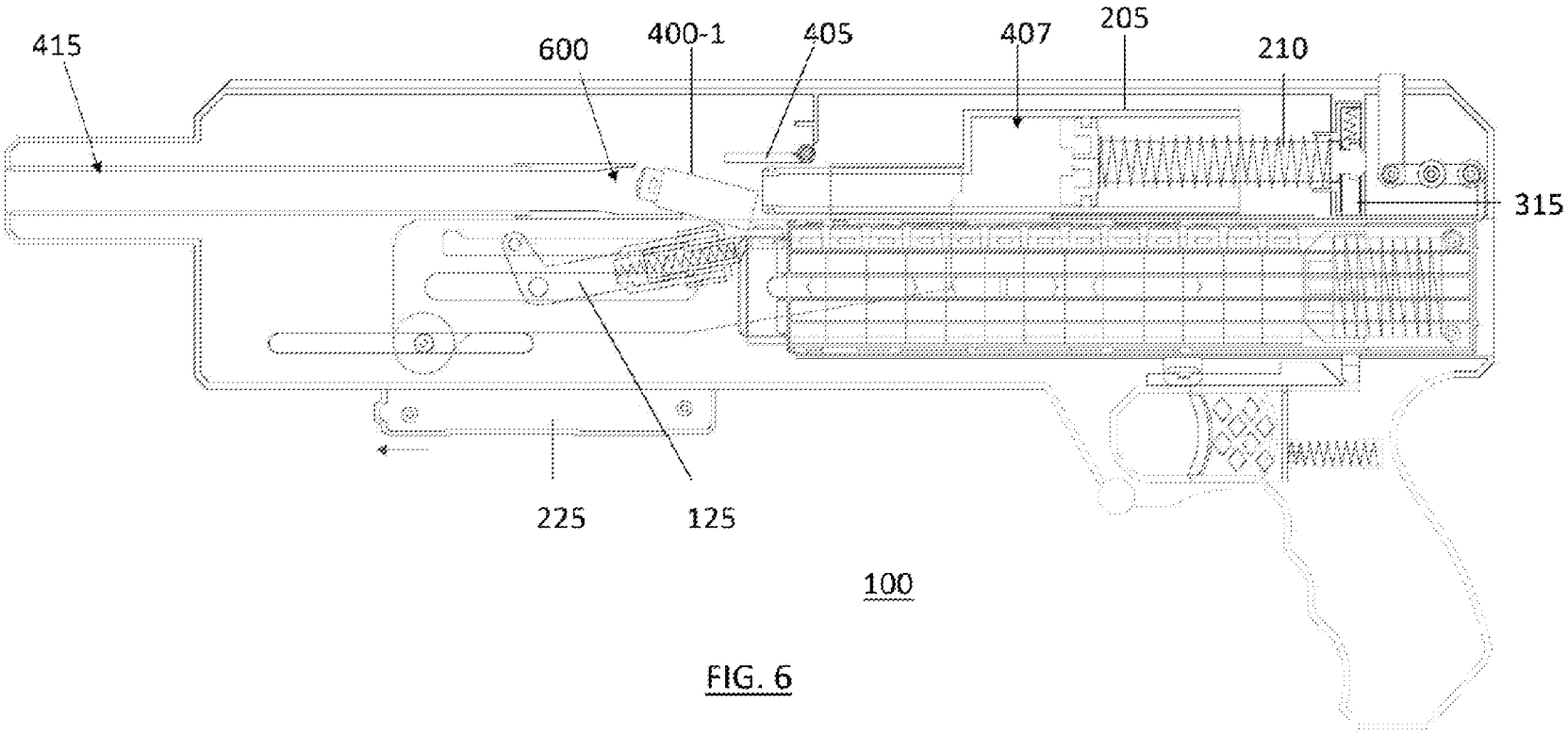
FIG. 6 is a schematic partial cross-sectional side view of a continuation from FIG. 5 of the projectile launcher of FIG. 2 being placed in a forward firing position according to an exemplary embodiment of the present disclosure.
Figure 7:
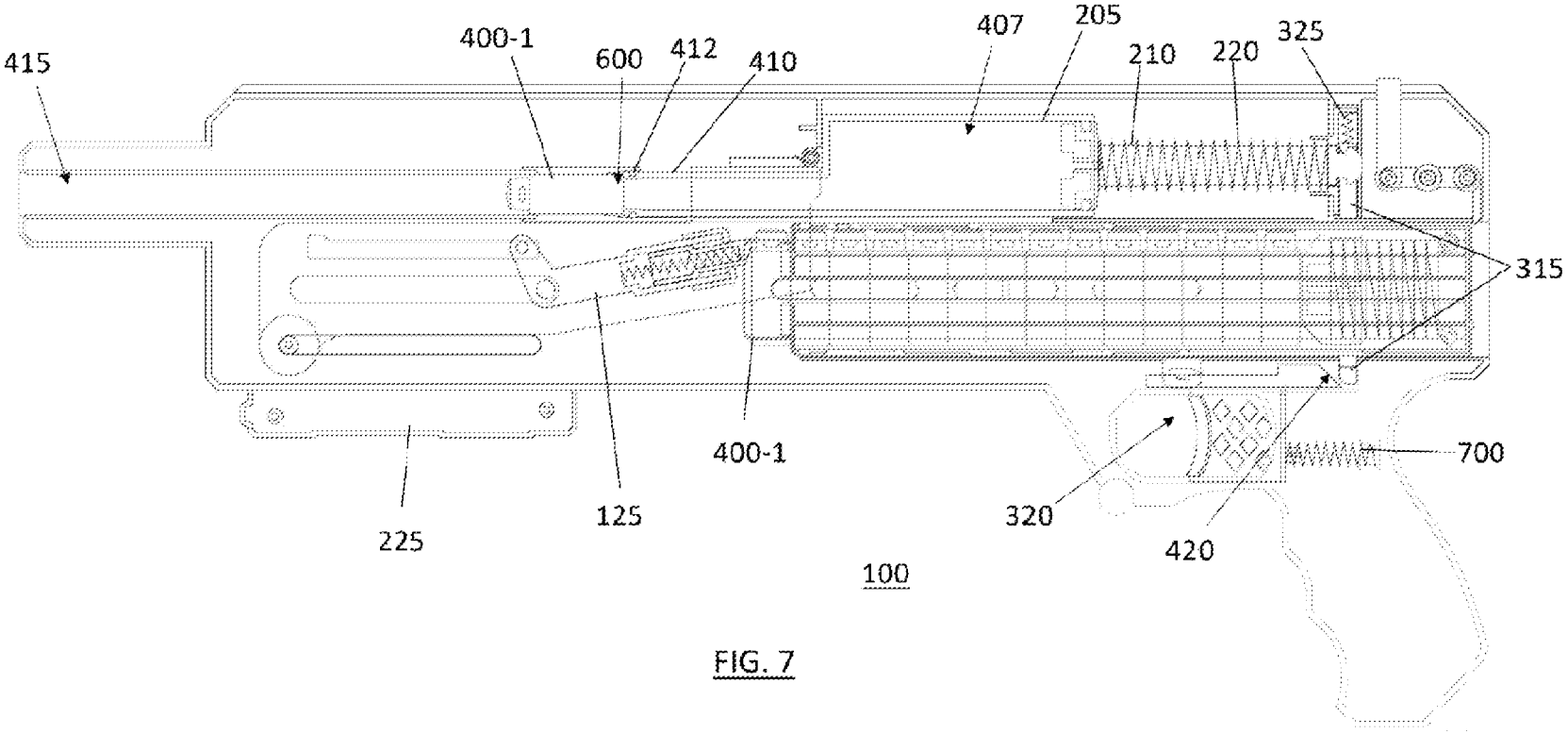
FIG. 7 is a schematic partial cross-sectional side view of a continuation from FIG. 6 of the projectile launcher of FIG. 2 being placed in a forward firing position according to an exemplary embodiment of the present disclosure.
Figure 8A:
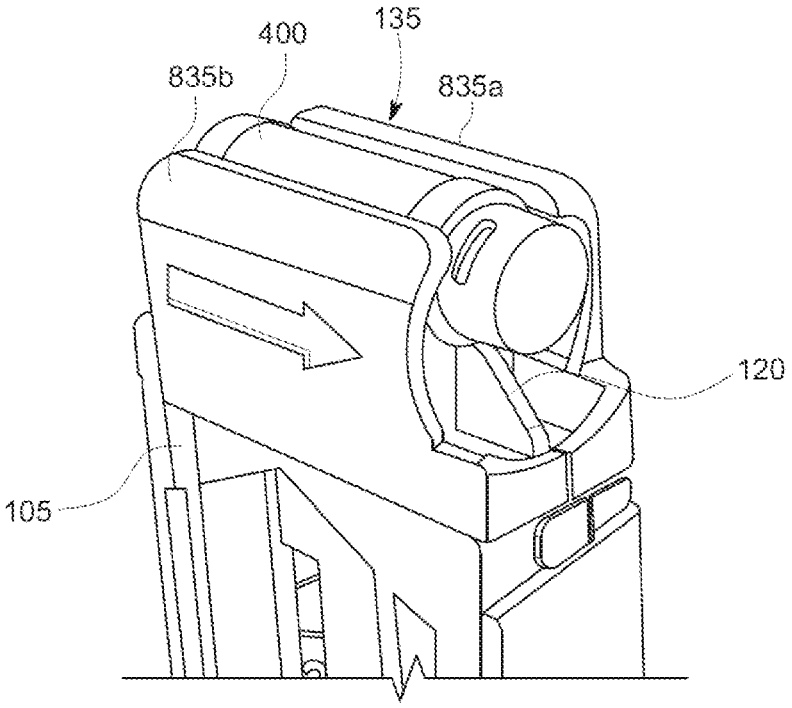
FIGS. 8A, 8B, 8C, 8D, and 8E are illustrations of a cartridge that is compatible with the projectile launcher according to an exemplary embodiment of the present disclosure.
Figure 8B:
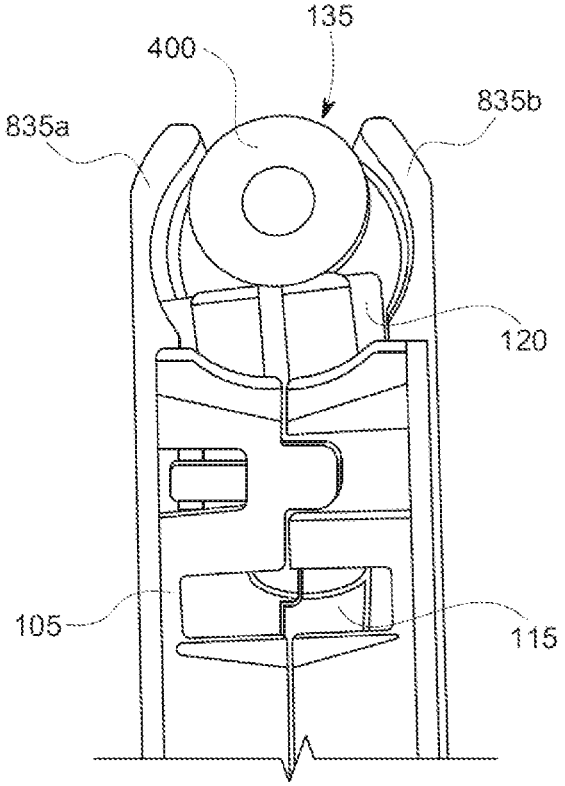
Figure 8C:
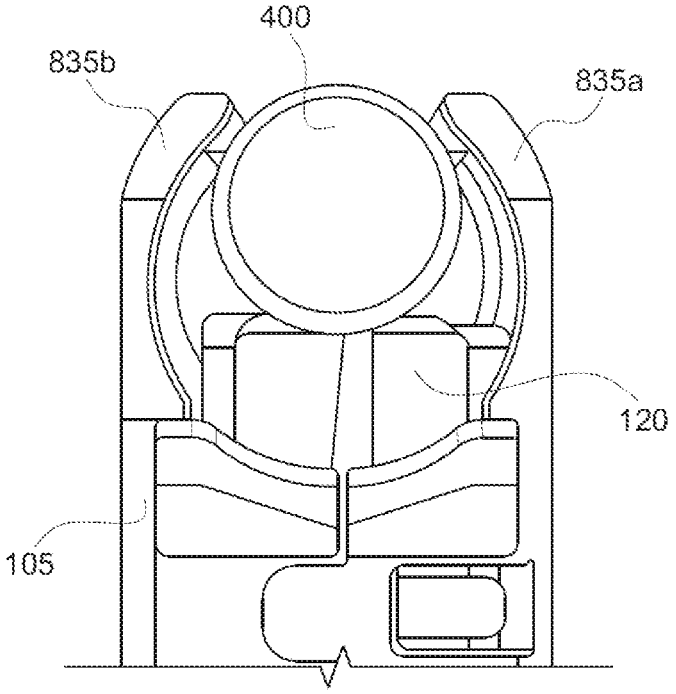

FIGS. 8A, 8B, and 8C are perspective, bottom, and top views of the cartridge 105, respectively, when it is oriented in the position shown in FIGS. 1A through 7, showing frame 135 on cartridge 105 holding a foam dart 400. As shown therein, frame 135 includes two generally rounded stops 835*a* and 835*b* that are dimensioned to hold dart 400 in place at a front portion thereof as pusher block 120 and compression spring 115 push dart 400 forward. As further shown in FIGS. 8A-8C, stops 835*a* and 835*b* abut respective sides of dart 400 slightly above the diameter of dart 400 such that the force from compression spring 115 would press dart 400 against stops 835*a* and 835*b*, thus holding and aligning dart 400 for priming as will be described in further detail below. FIG. 8C includes dimensions related to stops 835*a* and 835*b* for fitting a foam dart 400. It should be appreciated that the dimensions shown in FIG. 8C are merely exemplary, and other dimensions may be appropriate that fall within the spirit and scope of the present invention.

Figure 2:
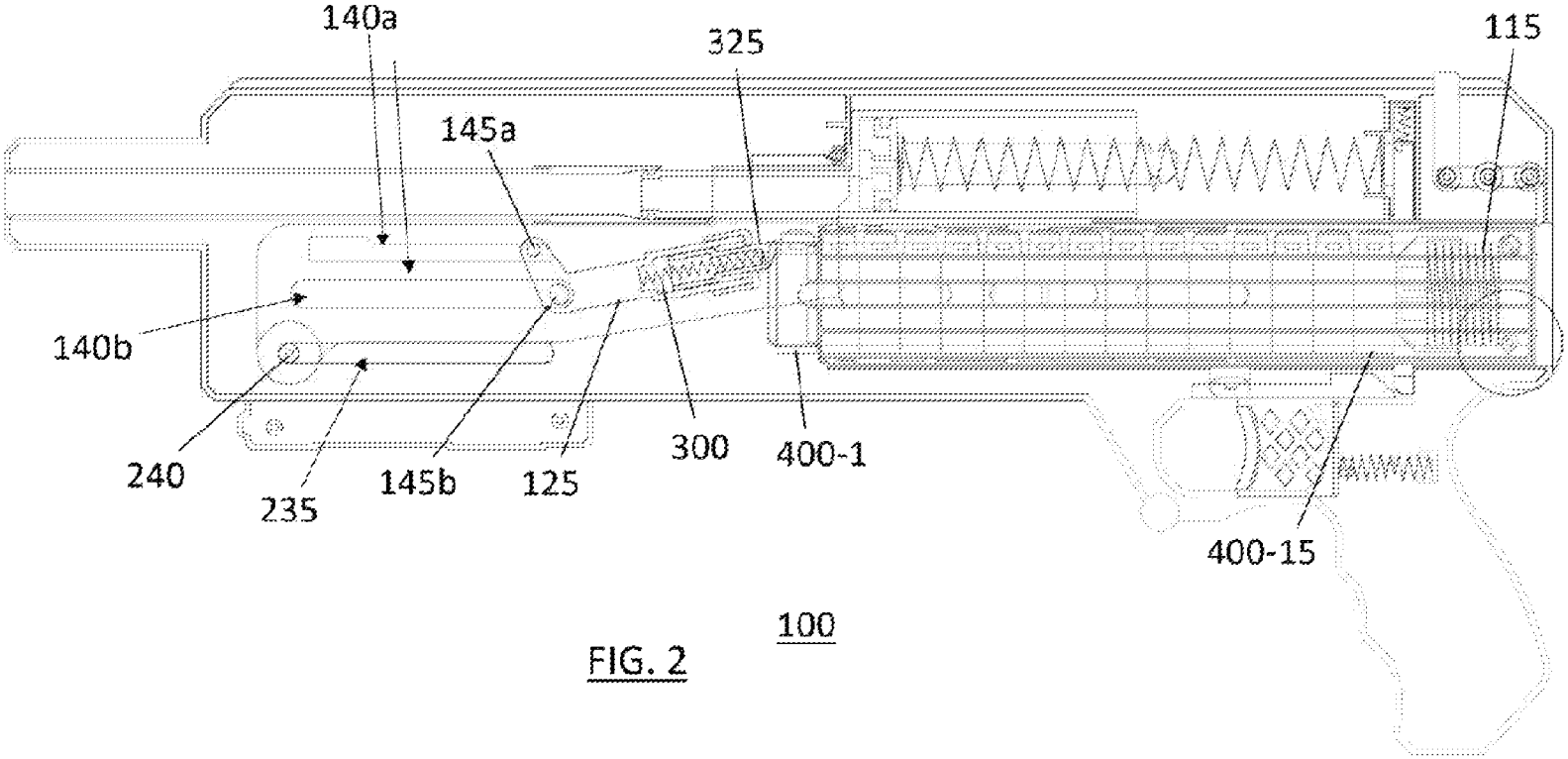
FIG. 2 is a schematic partial cross-sectional side view of a projectile launcher with an inserted fully-loaded cartridge according to an exemplary embodiment of the present disclosure.

Stops 835*a* and 835*b* may be made from a resilient material, such as a semi-rigid polymer, so that the stops 835*a* and 835*b* are sufficiently rigid to hold dart 400 against the force of compression spring 115 via block 120 while flexible enough to allow a user to push dart 400 into the position shown in FIGS. 8A-8C over the top of the gap between stops 835*a* and 835*b* of frame 135 illustrated therein. Accordingly, darts can be loaded vertically into cartridge 105 by pushing them down against block 120 through the top opening of cartridge 105 and by either sliding a next dart in between the two rounded stops 835*a* and 835*b* of frame 135 from the front side or back side of cartridge 105 or by pushing the next dart down between the two rounded stops 835*a* and 835*b* of frame 135 from the top side of cartridge 105 (thereby flexing the two stops 835*a* and 835*b* of frame 135 around the two sides of the loaded dart 400). Again, according to an exemplary embodiment of the present invention, the two rounded stops 835*a* and 835*b* of frame 135 are made of a semi-rigid material and dimensioned to fit a loaded projectile so that a forward-most loaded projectile—for example dart 400-1 while cartridge 105 is inserted into launcher 100 as shown in FIG. 2—would be held in place without slipping out either from the front side or back side of cartridge 105—in other words, the top side or the bottom side of cartridge 105 in the configuration shown in FIG. 2.

Figure 8D:
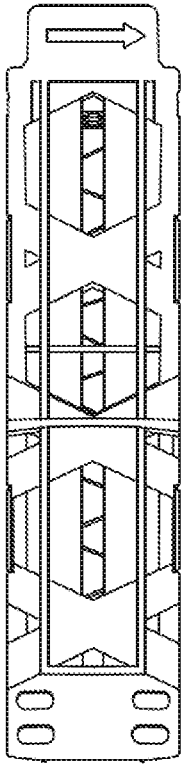
Figure 8E:
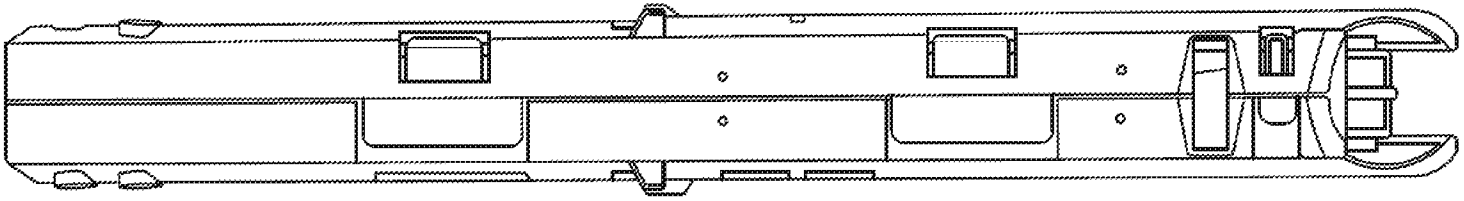

FIGS. 8D and 8E are side and back views of cartridge 105 showing the dimensions of respective components of cartridge 105 according to an exemplary embodiment of the present disclosure. Cartridges having different dimensions accommodated by a launcher 100 having correspondingly different dimensions may also be used without departing from the scope and the spirit of the present invention.

Referring back to FIG. 1A, reciprocating frame 230 incorporates two tracks 140*a* and 140*b* that are substantially parallel to track 235. Corresponding pins 145*a* and 145*b* of reciprocating feed lever 125 are slidably engaged, respectively, to tracks 140*a* and 140*b* so that reciprocating frame 230 can slide along tracks 140*a* and 140*b* against lever 125 when reciprocating frame 230 is moved back and forth by a user moving cocking slide 225 back and forth. According to an exemplary embodiment, pin 145*b* of the feed lever 125 is anchored to housing 110 of launcher 100 to allow feed lever 125 to pivot up and down, as will be described in further detail below. Additionally, lever 125 is disposed between two side portions of reciprocating frame 230. Thus, the front portion of reciprocating frame 230 may be embodied by a U-shaped element, or the like, that incorporates respective tracks 140*a* and 140*b* on the left and right sides for couplings to the two sides of feed lever 125 via respective pins 145*a* and 145*b*. Correspondingly, track 235, along which reciprocating frame 230 slides against housing 110 of launcher 100, may be incorporated on the outside of the two side elements of reciprocating frame 230 or on a center block element disposed below the position of feed lever 125 shown in FIG. 1A. As will be described in further detail below, the reciprocating frame 230 allows a user to pull back cocking slide 225 in order to move barrel 205 and plunger element 210 backwards in a first, pull-back, priming step.

Although the manner by which the reciprocating frame 230 moves relative to the housing and the manner by which the feed lever 125 moves relative to the frame 230 are described with reference to pins and tracks, it is to be understood that exemplary embodiments of the present invention are not limited to these constructions, and any other manner in which the reciprocating frame can be mounted to reciprocate relative to the housing while restrained between a first and second position and any other manner by which the feed lever 125 can be mounted to pivot relative to the housing shall be deemed to be within the scope of this invention. Further, it should be appreciated that the feed lever 125 may be replaced with any other type of mechanism that does not necessary pivot (for example, the movement may be vertically up and down relative to the housing upon reciprocating movement of the frame 230) to eject a projectile from the cartridge.

FIG. 2 is a schematic side cross-sectional view of the fully loaded storage area in the cartridge 105, which is inserted into projectile launcher 100 through a rear cartridge receptacle opening 130 according to an exemplary embodiment of the present invention. According to an exemplary embodiment of the present invention, a fully-loaded cartridge 105 houses fifteen (15) darts 400 (400-1 . . . 400-15). As shown in FIG. 2, the loaded darts 400 are oriented vertically, upward when cartridge 105 is loaded in launcher 100. Thus, the loaded darts 400 are oriented in a direction that is orthogonal to a launch direction of launcher 100. As will be described in further detail below, launcher 100 according to an exemplary embodiment of the present disclosure provides for re-orienting the frontmost loaded dart 400-1 from the upward loaded orientation to a forward launch orientation in the firing barrel of launcher 100. It is noted that the length of cartridge 105 and the corresponding length of housing 110 for accommodating cartridge 105 may be changed without departing from the spirit and scope of the disclosure, thus providing for housing more or fewer darts 400 in cartridge 105. Different lengths and capacities for any number of darts 400-*n* up to a reasonable length can be used so long as not to render launcher 100 overly cumbersome. As illustrated in FIG. 2, the frontmost dart 400-1 in loaded cartridge 105, which is held between round extensions of frame 135 shown in FIGS. 1A and 1B, is pushed against a tip portion 325 of feed lever 125. Tip portion 325 is coupled to the remainder of lever 125 via an internal compression spring 300 and is, therefore, compressible and extendible. As shown in FIG. 2, dart 400-1 pushes against tip portion 325 and compresses spring 300 such that lever 125 is compressed against dart 400-1.

Figure 3:
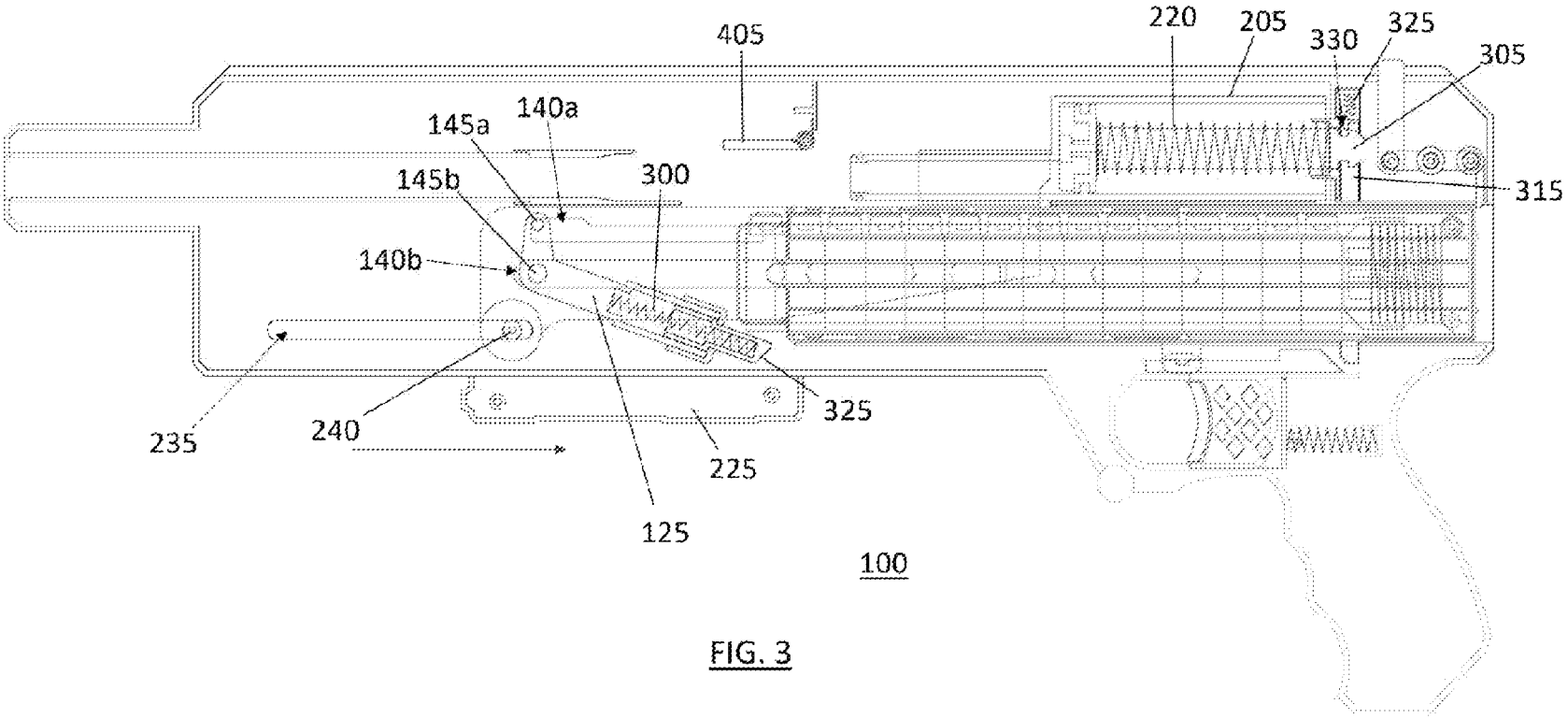
FIG. 3 is a schematic partial cross-sectional side view of the projectile launcher of FIG. 2 being placed in a rearward loading and priming (cocked) position.

Next, FIG. 3 is a schematic partial cross-sectional side view of the projectile launcher of FIG. 2 being placed in a rearward loading and priming (cocked) position. As illustrated in FIG. 3, cocking slide 225 is pulled backwards by a user (see arrow), which causes reciprocating frame 230 to slide backwards on track 235. Correspondingly, piston assembly 255, which is coupled to frame 230 is moved backwards, causing spring 220 to be compressed between plunger element 210 and back wall 215. Advantageously, plunger element 210 starts at a position near a front portion of barrel 205, as shown in FIG. 1A, and, therefore, compression spring 220 may be fully compressed in the position illustrated in FIG. 3. Back wall 215 includes an aperture that allows a dome-shaped tip portion 305 of plunger element 210 to extend through and past another aperture that is incorporated in a spring-loaded plate 315 that is, in turn, coupled to a trigger assembly 320 (see FIG. 1A). As illustrated in FIG. 1A, plate 315 is coupled to a compression spring 325 that biases plate 315 downward towards a trigger assembly 320. According to an exemplary embodiment of the disclosure, the leading edge of dome-shaped tip portion 305 is rounded and when it is pushed backward, the rounded leading sloped edge pushes upward on a top edge of the aperture in plate 315, compressing spring 325, so that tip portion 305 can be pushed through the aperture from the front of plate 315 to clear an opposing back side of plate 315, as illustrated in FIG. 3. Once tip portion 305 is pushed sufficiently past plate 315 through the aperture therein, spring 325 moves plate 315 downward into engagement with a notch or recess 330 opposite the rounded face of tip portion 305 (see FIG. 1A) so that tip portion 305—and, correspondingly, plunger element 210—is engaged with, and temporarily retained in place by plate 315. Notch 330 hooks to the opposing back side of plate 315 above the aperture therein once plate 315 is pushed downwardly by compression spring 325 into notch 330 and, accordingly, a top edge of the aperture is pushed into a bottom surface of notch 330 (see FIGS. 1A and 3)—thus, plate 315, compression spring 325, and notch 330 together form a latching assembly for holding plunger element 210 in the backward position. With plunger element 210 being pulled back by reciprocating frame 230, spring 220 is compressed against the back wall 215 of main launcher housing 110 in the position at which plate 315 and notch 330 are hooked and engaged with each other.

As further shown in FIG. 3, as reciprocating frame 230 is slid backward along track 235 via pin 240, tracks 140*a* and 140*b* are slid past pins 145*a* and 145*b* of lever 125. Additionally, track 140*b* is longer than track 140*a* such that the front end of track 140*b* reaches further forward than track 140*a*. Thus, upon reaching the engagement portion between notch 330 and plate 315 described above, a front end of track 140*a* pushes against pin 145*a* while track 140*b* continues to slide past pin 145*b*. Consequently, lever 125 pivots around pin 145*b* and tip 325 is tilted downward along the outer surface of the topmost dart 400-1 until it clears the bottom of dart 400-1. Once tip 325 clears dart 400-1, internal spring 300 decompresses and extends tip 325 and lengthens lever 125. As shown in FIG. 3, tip 325 extends to a sufficient length such that a top surface thereof can abut a back surface of dart 400-1 to push up against 400-1. As further illustrated in FIG. 3, track 235 serves as a structural stop to limit the backward motion of cocking slide 225 to the above full extension position—i.e., the engagement position between notch 330 and plate 315, and the extension position of lever 125 below dart 400-1.

Figure 4:
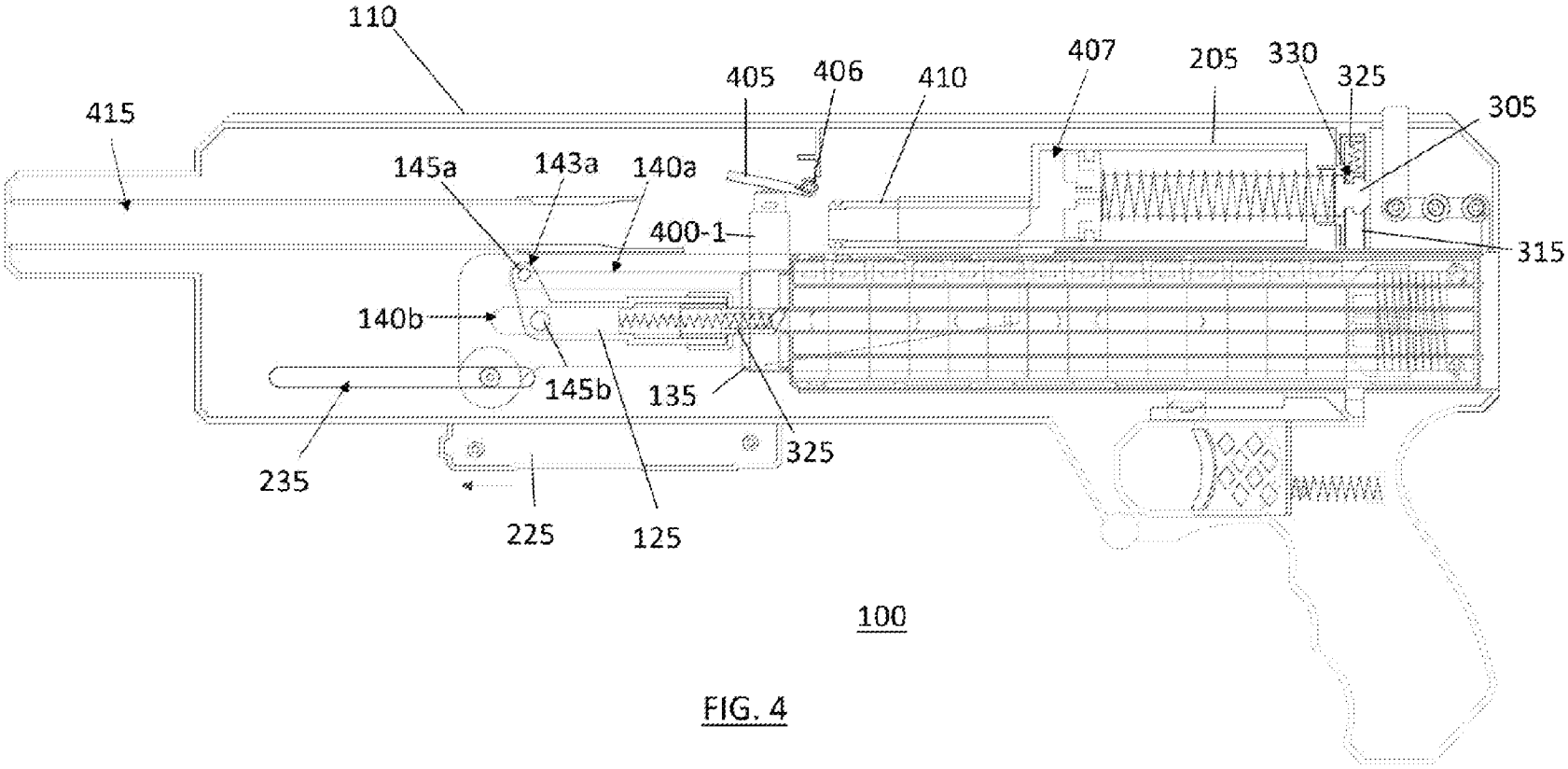
FIG. 4 is a schematic partial cross-sectional side view of the projectile launcher of FIG. 2 at an initial stage of being placed in a forward firing position according to an exemplary embodiment of the present disclosure.
Figure 5:
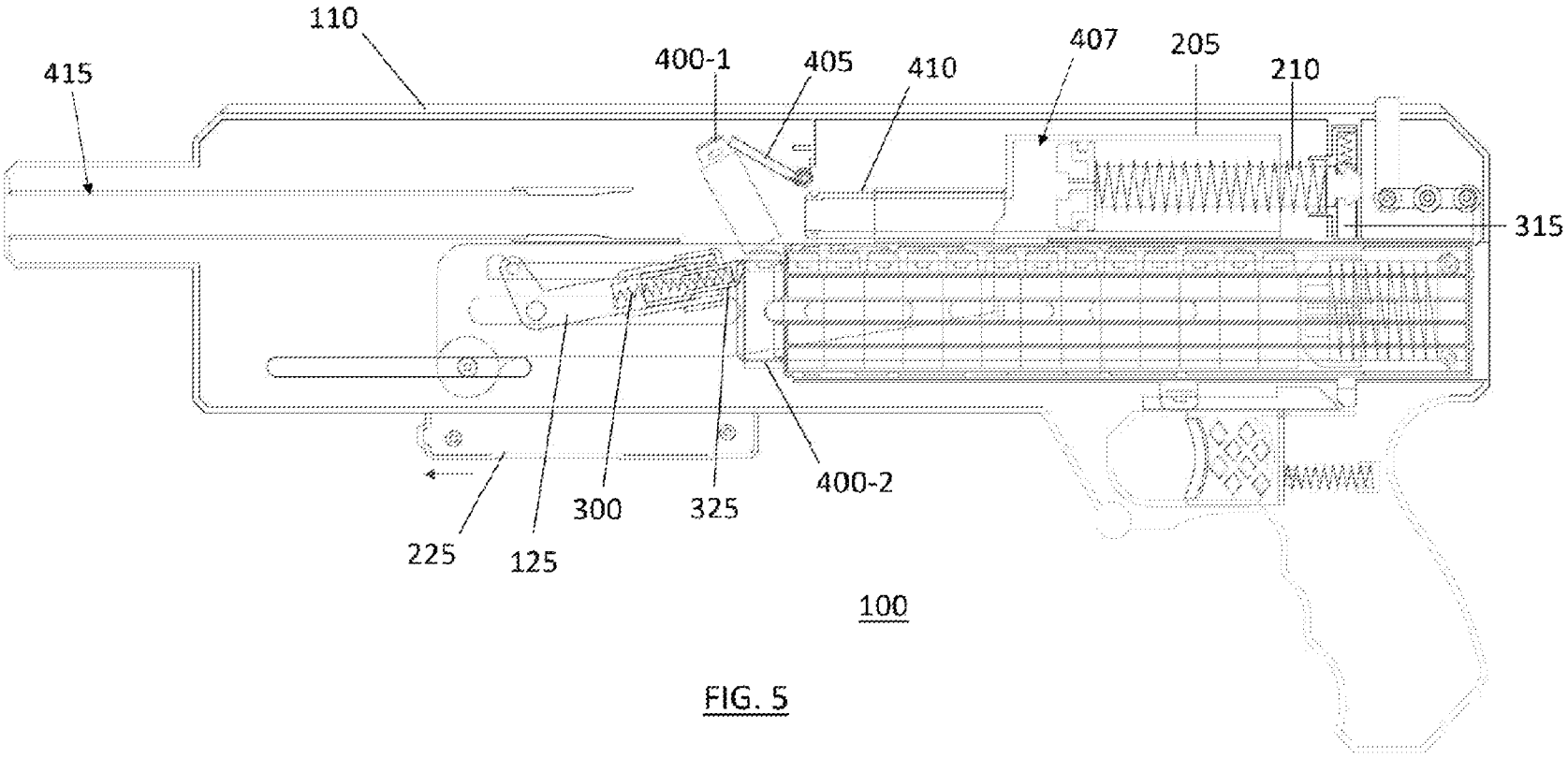
FIG. 5 is a schematic partial cross-sectional side view of a continuation from FIG. 4 of the projectile launcher of FIG. 2 being placed in a forward firing position according to an exemplary embodiment of the present disclosure.

With the notch/recess 330 of rod portion 305 engaged with plate 315 via the downward bias of spring 325, the user can push cocking slide 225 forward in a second priming step—again, in a similar fashion to a pump action shotgun—see forward arrow adjacent cocking slide 225 in FIGS. 4-6. Consequently, according to an exemplary embodiment of the present invention, reciprocating frame 230 slides forward along track 235 during the forward motion of cocking slide 225. Thus, barrel 205 is compelled to slide forward towards the front of launcher 100 while rod portion 305 and plunger element 210 are held in place by plate 315. As shown in FIGS. 4-6, compression spring 220 remains fully compressed by the return of cocking slide 225 to its original forward position.

FIG. 4 illustrates a first interim position on the forward priming motion of cocking slide 225, where lever 125 begins tilting back upward to push dart 400-1 upward towards a spring-loaded flap 405. As shown in FIG. 4, a camming notch 143*a* on track 140*a* pushes against pin 145*a* in a forward direction as reciprocating frame 230 is slid forward along track 235 along with cocking slide 225. Consequently, lever 125 is tilted upward and tip 325 thereof, now extended past and engaging the bottom of dart 400-1, pushes dart 400-1 upward through frame 135. As described before, frame 135 may include two rounded semi-resilient extensions that hold dart 400-1 in place. Thus, with sufficient force applied by camming notch 143*a* against pin 145*a*, dart 400-1 is slid upward between the rounded extensions of frame 135 until the front tip of dart 400-1 abuts flap 405, as illustrated in FIG. 4. Flap 405 is biased downward towards the position shown in FIGS. 1A and 3 by a torsion spring 406 that is positioned towards the rear end of launcher 100 in relation to dart 400-1. Thus, flap 405 rotates upward and backward as the tip of dart 400-1 is pushed upward against it. Consequently, flap 405 exerts a generally downward and forward force on the front tip of dart 400-1—thus, re-orienting dart 400-1 from pointing upward to pointing forward adjacent the launch barrel 415 of launcher 100. Additionally, with plunger element 210 temporarily coupled to back plate 315, plunger element 210 begins to form an air chamber 407 within barrel 205 whereby air is drawn in through a front nozzle 410 of barrel 205, as illustrated in FIG. 4. In accordance with an exemplary embodiment of the present disclosure, nozzle 410 may be of a substantially smaller diameter than that of the air chamber 407 so that a forward push by plunger 210 would expel the air through nozzle 410 at a higher pressure.

FIG. 5 illustrates a second interim position that is a continuation from FIG. 4 of the projectile launcher 100 being placed in a forward firing position from the backward cocked position of FIG. 3 according to an exemplary embodiment of the present invention. As shown in FIG. 5, when dart 400-1 is pushed sufficiently upward by lever 125 into the upper portion of housing 110, a next dart 400-2 is pushed forward to the position in frame 135 by compression spring 115 and block 120 via the other loaded darts 400. As a result, internal compression spring 300 and tip 325 of lever 125 is returned to their shortened configuration, as shown in FIG. 2, against the outer surface of dart 400-2. Separately, flap 405 continues to exert a generally downward and forward force on the front tip of dart 400-1—thus, continuing to re-orient dart 400-1 from pointing upward to pointing forward within launcher 100. Additionally, with plunger element 210 still temporarily coupled to back plate 315, plunger element 210 continues to form an air chamber 407 within barrel 205 whereby air is drawn in through a front nozzle 410 of barrel 205, as illustrated in FIG. 5.

Next, FIG. 6 illustrates a third interim position that is a continuation from FIG. 5 of the projectile launcher 100 being placed in a forward firing position from the backward cocked position of FIG. 3 according to an exemplary embodiment of the present invention. As shown in FIG. 6, the front tip of dart 400-1 is pushed sufficiently forward and downward by flap 405 so that it is generally oriented forward towards launch barrel 415 in front of nozzle 410 of barrel 205. Additionally, with cocking slide 225 continuing to be moved forward (see arrow) and plunger element 210 still temporarily coupled to back plate 315, air chamber 407 continues to be expanded within barrel 205 whereby air is drawn in through a front nozzle 410 of barrel 205. As illustrated in FIG. 6, the rear portion of launch barrel 415 includes a tapered opening 600 for receiving dart 400-1, which is generally oriented forward, and for guiding it into launch barrel 415. Operatively, as barrel 205 and nozzle 410 are moved forward via cocking slide 225, nozzle 410 pushes on the rear end of dart 400-1 to move it forward towards launch barrel 415. As shown in FIG. 6, front tip of dart 400-1 enters the tapered opening 600 and slides along the slanted walls of tapered opening 600 for inserting dart 400-1 into launch barrel 415.

Consequently, as illustrated in FIG. 7, dart 400-1 is aligned and inserted into launch barrel 415 with a front portion of nozzle 410 inserted into tapered portion 600 to form an airtight connection between air chamber 407 and the rear end of dart 400-1.

Thus, FIGS. 3-6 illustrate cocking slide 225 being moved forward in the direction shown by the forward arrows therein, resulting in the topmost dart 400-1 being primed into the position in front of barrel 410 within launch barrel 415 in a firing position, as shown in FIG. 7. According to an exemplary embodiment of the present invention, launch barrel 415 has an internal diameter that provides minimal clearance for darts 400 to allow for substantially airtight propulsion from launch barrel 415 upon release of the pressurized air from air cylinder assembly 255.

As illustrated in FIGS. 1-7, the rear tapered portion 600 of launch barrel 415 is of a slightly larger internal diameter for fittingly receiving front nozzle 410 of barrel 205, thereby, again, providing for a substantially airtight connection from air chamber 407 to the rear surface of dart 400-1 in the launch position within launch barrel 415. According to an exemplary embodiment of the present invention, nozzle 410 incorporates an O-ring 412 made from a resilient material, such as a polymer, around its outer circumference to form a seal around the internal circumference of the rear portion of launch barrel 415 to further improve the airtight connection.

With dart 400-1 in position shown in FIG. 7, launcher 100 is ready for a trigger pull and launch action. As illustrated in FIG. 7, an interface between the rear portion of trigger assembly 320 and locking plate 315 includes an inclined camming surface 420 so that, when trigger assembly 320 is pulled backward by the user, locking plate 315 is caused to move upward by sliding up along inclined camming surface 420 against spring 325. As shown in FIG. 7, trigger assembly 320 is biased forward in a default position by a spring 700 such that plate 315 is disengaged from the inclined surface 420 when trigger 320 is in the forward, default, non-firing position.

As a user pulls trigger assembly 320 backward and, as trigger assembly 320 is slid backwards, camming surface 420 is pushed backwards and, accordingly, slides plate 315 upward. Consequently, as plate 315 is pushed upward by inclined surface 420 of trigger assembly 320, the engagement between plate 315 and notch/recess 330 of tip portion 305 is released as the aperture of plate 315 is moved upward to a position that clears notch/recess 330. Thus, spring 220 is released from its fully compressed state thereby driving plunger element 210 forcefully forward to thereby expel the collected air from air chamber 407 through nozzle 410 to launch dart 400-1 through launch barrel 415. Correspondingly, trigger assembly 320 is returned to the forward default position by spring 700 and plate 315 is returned to its lowered position by compression spring 325. According to an exemplary embodiment of the present disclosure, cocking slide 225 may be pulled backward again to the position shown in FIG. 3 to prime a next dart 400—e.g., 400-2—from the storage cartridge 105 into the firing position shown in FIG. 7.

In accordance with an exemplary embodiment of the present invention, barrel 205 may embody a larger internal volume for air chamber 407—thus increasing the launch force of launcher 100 on dart 400. As shown in FIGS. 1-7, barrel 205 has an increased height when com-pared, for example, to launch barrel 415. According to an exemplary embodiment, internal air cylinder assembly 255 incorporates an elongated cross section in its height dimension—such as an oval shape. Accordingly, internal air cylinder assembly 255 may maintain a similar width to, say, launch barrel 415 while increasing its height—for example, a 7:5 height-to-width ratio (35 mm:25 mm).

Although the exemplary embodiment is described in the context of a foam bullet/dart launcher that utilizes shortened foam bullets/darts, it is to be understood that the two-step priming/loading and firing action according to the present disclosure could be applied to a toy projectile launcher of other types of projectiles (e.g. a ball or the like) or a fluid launcher whereby the fluid from a reservoir in place of the cartridge is driven by a plunger. In such environment the two-step priming/pumping action and the lever reorientation assembly of the present disclosure enables pump action launcher that provides for projectile or fluid connection reorientation, which would, in turn, contribute to miniaturization of the launcher.

In an exemplary embodiment of the present invention, rather than feeding the dart straight from a storage cartridge and then reoriented into a firing position using a spring-loaded flap (or some other mechanism) that directly contacts the dart, as described previously, the dart may first be loaded from the cartridge into a protective housing such as an open cylinder and then the housing may be reoriented so that the dart is aligned with the firing position. The housing achieves the objectives of preventing wear to the dart tip, which might otherwise occur from the dart tip directly contacting the internal walls of the launcher during reorientation into the firing position, and minimizing fatigue of the dart body, which might otherwise result from repetitive manipulation of the dart, causing jams and other malfunctions.

Figure 9:
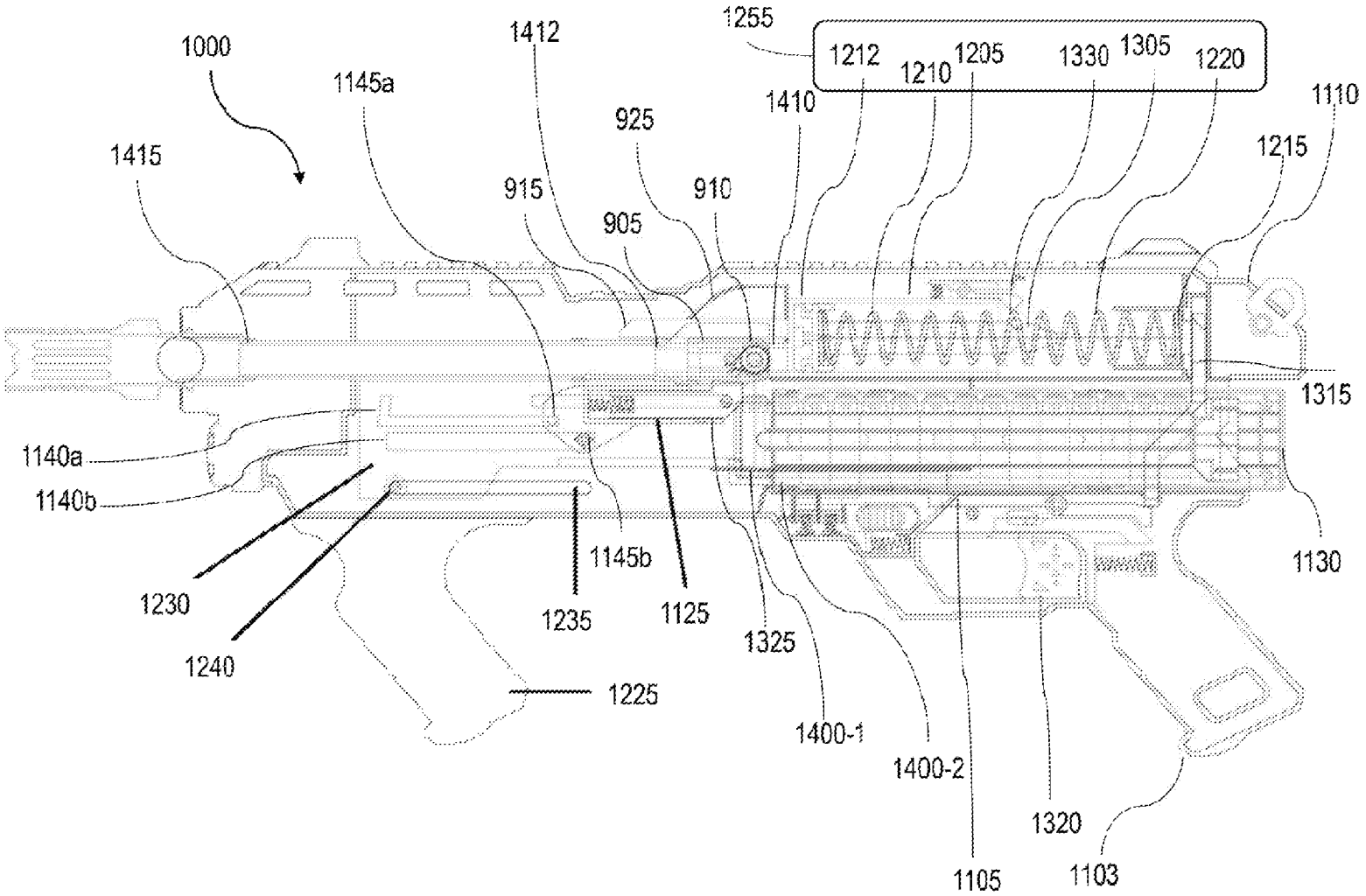
FIG. 9 is a schematic partial cross-sectional side view of a projectile launcher with an inserted fully-loaded cartridge according to an exemplary embodiment of the present invention.

FIG. 9 is a schematic partial cross-sectional side view of a toy projectile launcher 1000 with an inserted fully loaded cartridge according to an exemplary embodiment of the present disclosure. This exemplary embodiment is similar to the prior-described embodiments and includes identical components, except that a cylinder is provided to accept a toy dart from a storage cartridge and therefore protect the dart during reorientation into the firing position, thereby addressing concerns with dart-tip wear and jams caused by fatigued dart bodies.

Launcher 1000 includes a housing 1110 including a track 1235, launch barrel 1415, a reciprocating frame 1230 including tracks 1140*a* and 1140*b* and a pin 1240 slidably engaged with the track 1235, a feed lever 1125 including tip portion 1325 and pins 1145*a* and 1145*b* that are slidably engaged with the tracks 1140*a* and 1140*b*, respectively, of the frame 1230, and cocking slide 1225. The launcher further includes storage cartridge 1105, trigger assembly 1320, handle 1103, nozzle 1410, internal air cylinder assembly 1255, back wall 1215, and plate 1315. As shown in FIG. 9, internal air cylinder assembly 1255 includes resilient O-ring 1212, plunger element 1210, barrel 1205, notch hooks 1330, tip portion 1305, and spring 1220. The above components are housed within main launcher housing 1110. Storage cartridge 1105 stores foam darts 1400. Each of these components is substantially similar in structure and performs a substantially similar function as corresponding components depicted in FIGS. 1A, 1B and 2-7 for launcher 100.

Although the manner by which the reciprocating frame 1230 moves relative to the housing and the manner by which the feed lever 1125 moves relative to the frame 1230 are described with reference to pins and tracks, it is to be understood that exemplary embodiments of the present invention are not limited to these constructions, and any other manner in which the reciprocating frame 1230 can be mounted to reciprocate relative to the housing while restrained between a first and second position and any other manner by which the feed lever 1125 can be mounted to pivot relative to the housing shall be deemed to be within the scope of this invention. Further, it should be appreciated that the feed lever 1125 may be replaced with any other type of mechanism that does not necessary pivot (for example, the movement may be vertically up and down relative to the housing upon reciprocating movement of the frame 230) to eject a projectile from the cartridge.

As shown in FIG. 9, internal air cylinder assembly 1255 includes barrel 1205 and a plunger element 1210 located above handle 1103 and storage cartridge 1105 of projectile launcher 1000. According to an exemplary embodiment, the barrel 1205 of internal air cylinder assembly 1255 has a generally rounded cylindrical or an oval cross section and plunger element 1210 is held against but biased away from a back wall 1215 at the rear part of launcher housing 1110 by compression spring 1220. According to embodiments, when barrel 1205 of air cylinder assembly 1255 has an oval cross section, an internal air chamber 1407 (depicted and described below) of air cylinder assembly 1255 is formed and has increased capacity without needing to increase the thickness of launcher 1000. The plunger element 1210 incorporates a size and a shape that correspond with an internal circumference of barrel 1205 so as to form an airtight seal with an internal surface of barrel 1205. Plunger element 1210 also incorporates a resilient O-ring 1212 to form an improved seal. As shown in FIG. 9, barrel 1205 is coupled to cocking slide 1225 via the reciprocating frame 1230 that is fittingly coupled to, along with cocking slide 1225, the track 1235 incorporated in the housing 1110 of launcher 1000. As shown in FIG. 9, the pin 1240 of the reciprocating frame 1230 slides along track 1235 when cocking slide 1225 is cocked back and forth similar to a pump action shotgun, which, in turn, primes internal air cylinder assembly 1255 while feeding a foam dart 1400 into cylinder 905 for launching, as will be described in further detail below. In embodiments, cocking slide 1225 may be coupled to reciprocating frame 1230 via pin 1240 as well.

As shown in FIG. 9, nozzle 1410 incorporates an O-ring 1412 around its outer circumference. In embodiments, O-ring 1412 is made from a resilient material, such as a polymer, similar to O-ring 412 depicted in and described in connection with FIG. 7. Similar to O-ring 412, O-ring 1412 forms a seal around the internal circumference of the rear portion of launch barrel 1415.

In addition to the above components, the exemplary embodiment depicted in FIG. 9 replaces spring-loaded flap 405 from launcher 100 with a cylinder 905. Cylinder 905 is shaped and sized to accept a foam dart to be loaded therein. As shown in FIG. 9, although cylinder 905 is biased into the vertical position by a torsion spring 910, as discussed below, cylinder 905 is held in the horizontal position by engagement with air nozzle 1410. In FIG. 9, toy projectile launcher 1000 is in a resting position. That is, toy projectile launcher 1000 is in an un-cocked position, whereby foam darts 1400 (including the depicted darts 1400-1 and 1400-2) are in storage cartridge 1105. In FIG. 9, none of the foam darts 1400 have yet been loaded into cylinder 905. Furthermore, cocking slide 1225 is in its resting forward position. In addition, nozzle 1410, as shown, passes though cylinder 905, retaining cylinder 905 in the horizontal orientation.

Figure 10:
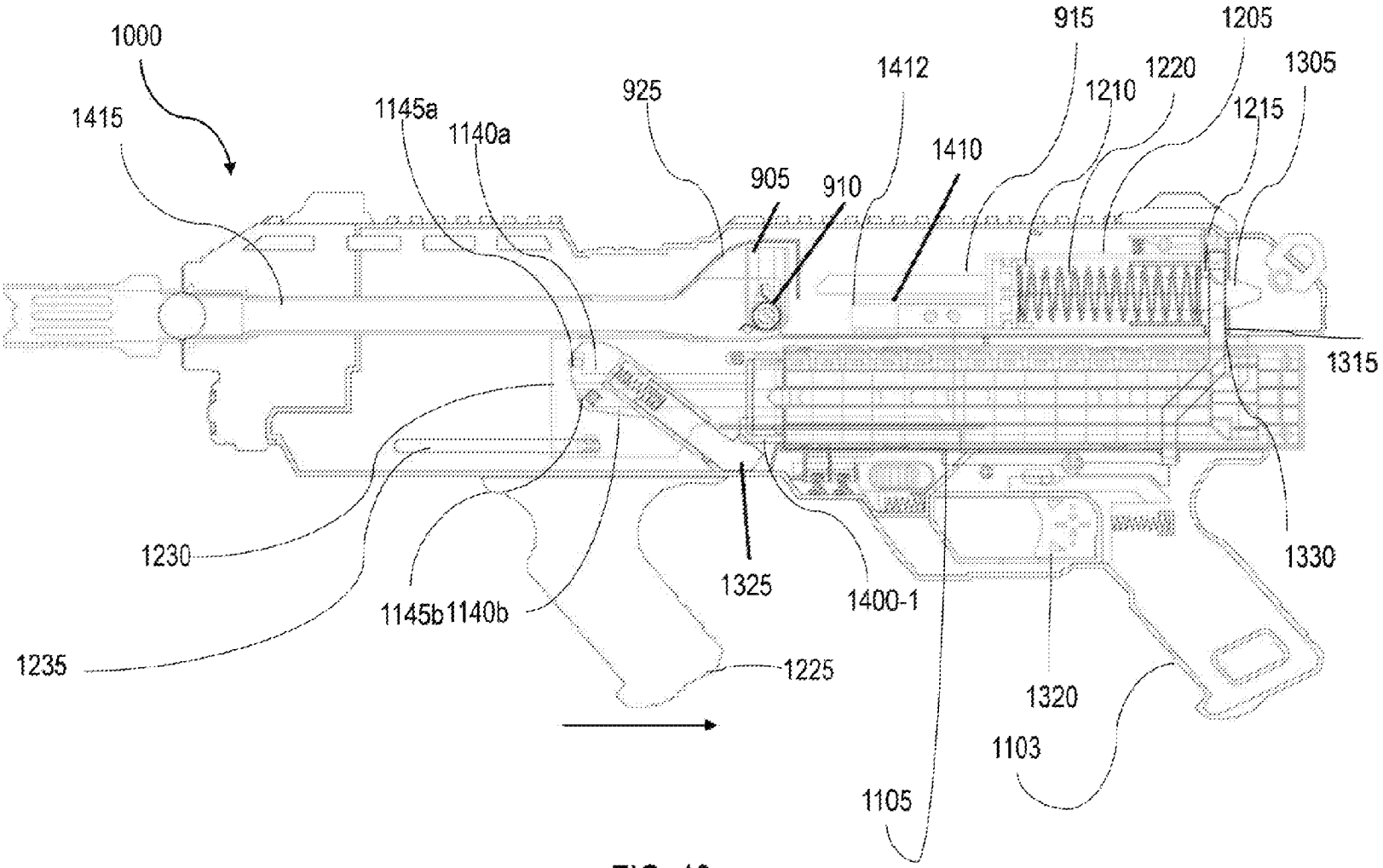
FIG. 10 is a schematic partial cross-sectional side view of the projectile launcher of FIG. 9 being placed in a rearward loading and priming (cocked) position.

FIG. 10 is a schematic partial cross-sectional side view of projectile launcher 1000 of FIG. 9 being placed in a rearward loading and priming (cocked) position, in accordance with an exemplary embodiment of the present disclosure. As shown in FIG. 10, cocking slide 1225 has been pulled back from its resting forward position to a position toward the rear of toy projectile launcher 1000, comprising a first priming step. When cocking slide 1225 is pulled back, reciprocating frame 1230 is operated and slides backwards on track 1235, which, in turn, moves internal air cylinder assembly 1255 (see FIG. 9) backwards. This causes spring 1220 to be compressed between plunger element 1210 and back wall 1215. According to embodiments, plunger element 1210 starts at a position near a front portion of barrel 1205, causing spring 1220 to become fully compressed.

Back wall 1215 includes an aperture that allows dome-shaped tip portion 1305 to extend through and past another aperture that is incorporated in spring-loaded plate 1315. According to an exemplary embodiment, the leading edge of dome-shaped tip portion 1305 is rounded and when it is pushed backward, it is pushed through the aperture from the front of plate 1315 to clear an opposing back side of plate 1315, as illustrated in FIG. 10. Once tip portion 1305 is pushed sufficiently past plate 1315 through the aperture therein, plate 1315 engages with notch 1330 opposite the rounded face of tip portion 1305 so that tip portion 1305—and, correspondingly, plunger element 1210—is engaged with, and temporarily retained in place by plate 1315. Notch 1330 hooks to the opposing back side of plate 1315 above the aperture therein and, accordingly, a top edge of the aperture is pushed into a bottom surface of notch 1330—thus, plate 1315 and notch 1330 form a latching assembly for holding plunger element 1210 in the backward position. With plunger element 1210 being pulled back by reciprocating frame 1230, spring 1220 is compressed against the back wall 1215 of housing 1110 in the position at which plate 1315 and notch 1330 are hooked and engaged with each other.

Further, as shown in FIG. 10, air nozzle 1410, which is attached to internal air cylinder assembly 1255, also moves backward and out of cylinder 905. As also shown in FIG. 10, when nozzle 1410 exits cylinder 905, spring 910 restores cylinder 905 to an upright, vertical position.

Also, similar to the operation described in relation to the prior exemplary embodiment, movement of the cocking slide 1225 also results in pivoting of the feed lever 1125 downwards below the storage cartridge 1105, with extension of the tip portion 1325 below a dart to be loaded from the cartridge 1105.

Figure 11:
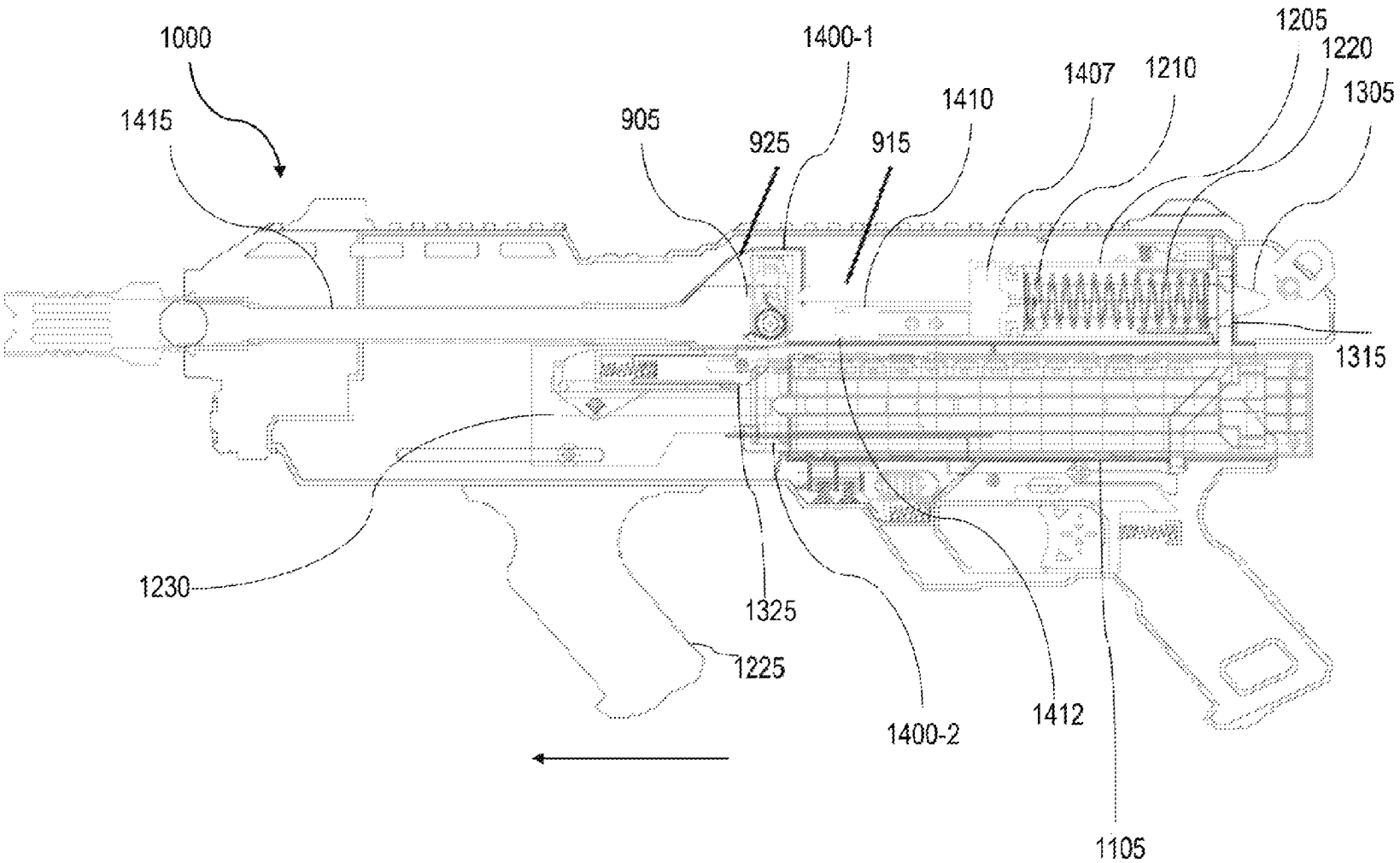
FIG. 11 is a schematic partial cross-sectional side view of the projectile launcher of FIG. 9 at an initial stage of being placed in a forward firing position according to an exemplary embodiment of the present invention.
Figure 12:
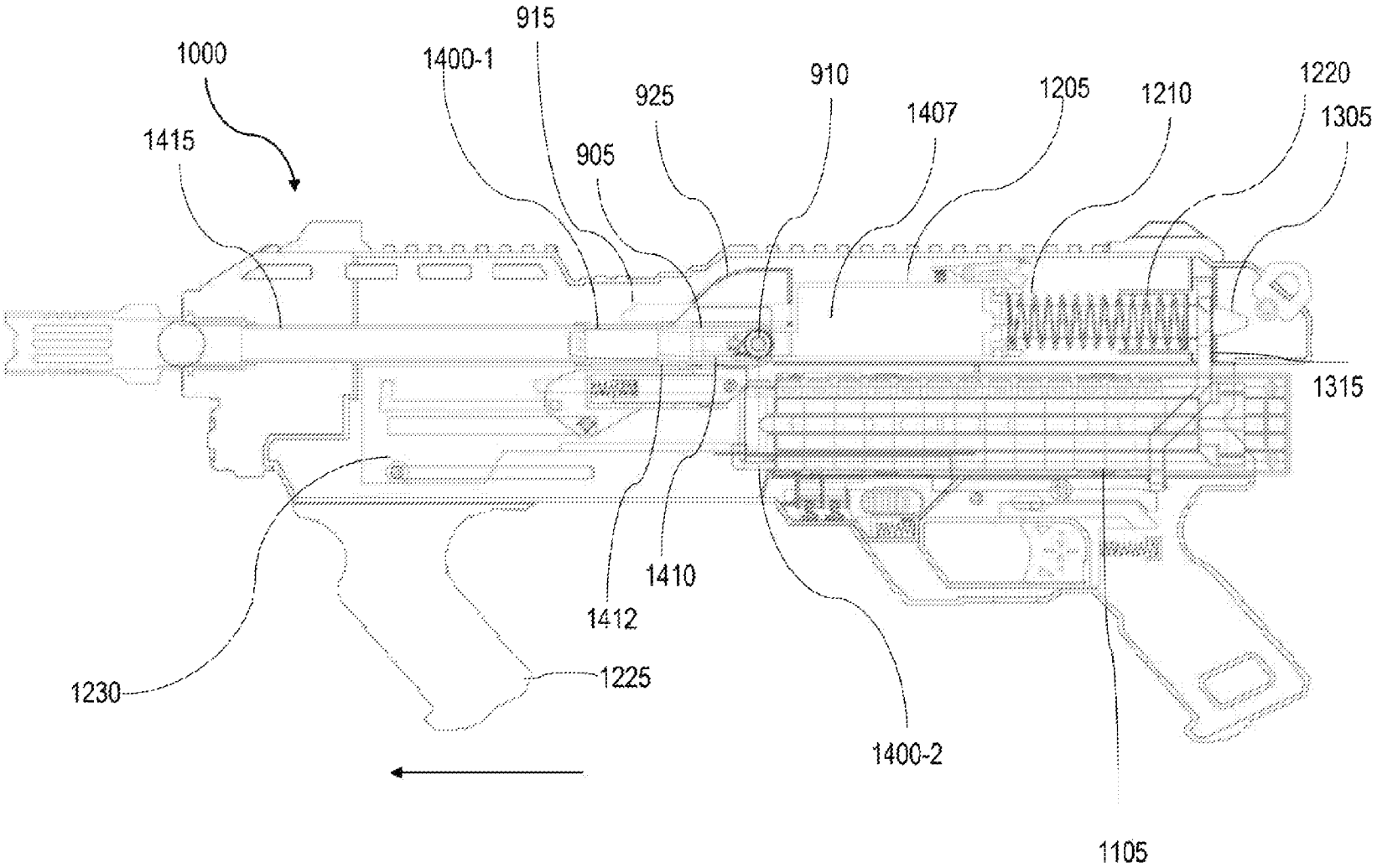
FIG. 12 is a schematic partial cross-sectional side view of a continuation from FIG. 11 of the projectile launcher of FIG. 9 being placed in a forward firing position according to an exemplary embodiment of the present invention.

FIG. 11 is a schematic partial cross-sectional side view of projectile launcher 1000 of FIG. 9 at an initial stage of being placed in a forward firing position according to an exemplary embodiment of the present disclosure. As shown in FIG. 11, cocking slide 1225 is pushed forward in a second priming step, which causes reciprocating frame 1230 to slide barrel 1205 forward towards the front of launcher 1000 while tip portion 1305 and plunger element 1210 are held in place by plate 1315. As shown in FIGS. 11-12, compression spring 1220 remains fully compressed by engagement of the leading edge of dome-shaped tip portion 1305 in an aperture in plate 1315 prior to the return of cocking slide 1225 to its original forward position. At the same time, tip portion 1325 of dart-feeding lever 1125 lifts the frontmost dart in cartridge 1105 upward and loads the dart into the vertically oriented cylinder 905. This is shown in FIG. 11, where dart 1400-1 has been lifted by tip portion 1325 and is loaded into cylinder 905 from cartridge 1105. In this exemplary embodiment, push rod 915 is attached to the front of barrel above nozzle 1410. As shown, push rod 915 is longer than nozzle 1410, and, as a result, reaches and engages cylinder 905 before nozzle 1410. Additionally, with plunger element 1210 temporarily coupled to back plate 1315, plunger element 1210 begins to form an air chamber 1407 within barrel 1205 whereby air is drawn in through a front of nozzle 1410 of barrel 1205, as illustrated in FIG. 11. In accordance with an exemplary embodiment of the present disclosure, nozzle 1410 may be of a substantially smaller diameter than that of the air chamber 1407 so that a forward push by plunger 1210 would expel the air through nozzle 1410 at a higher pressure.

FIG. 12 is a schematic partial cross-sectional side view of a continuation from FIG. 11 of projectile launcher 1000 of FIG. 9 being placed in a forward firing position according to an exemplary embodiment of the present disclosure. As shown in FIG. 12, cocking slide 1225 is moved forward to complete the second priming step. As the second priming step is completed, push rod 915 is also moved forward. As push rod 915 is moved forward, it causes cylinder 905 to rotate against the bias of spring 910 until cylinder 905 reaches a horizontal orientation, as shown in FIG. 12. As the cocking handle 1225 completes its travel, nozzle 1410 enters cylinder 905. O-ring 1412, which is at the distal end of nozzle 1410 that enters cylinder 905, comes into contact with dart 1400-1, which, as shown in FIGS. 10 and 11, has been loaded into cylinder 905. Nozzle 1410 exerts a horizontal force on dart 1400-1 and, as shown in FIG. 12, places the dart at the rear of launch barrel 1415. Further, O-ring 1412 of nozzle 1410 engages the rear portion of launch barrel 1415 so as to form an airtight seal between nozzle 1410 and launch barrel 1415. Additionally, with plunger element 1210 still temporarily coupled to back plate 1315, plunger element 1210 continues to form an air chamber 1407 within barrel 1205 whereby air is drawn in through nozzle 1410 into barrel 1205, as illustrated in FIG. 12.

Further, according to an exemplary embodiment of the present invention, launch barrel 1415 has an internal diameter that provides minimal clearance for darts 1400 to allow for substantially airtight propulsion from launch barrel 1415 upon release of the pressurized air from air cylinder assembly 1255.

As illustrated in FIG. 12, the rear portion of launch barrel 1415 is tapered and has a slightly larger internal diameter for fittingly receiving the distal end of nozzle 1410 of barrel 1205. This provides for a substantially airtight connection from air chamber 1407 through cylinder 905 to the rear surface of dart 1400-1 in the launch position within launch barrel 1415. As noted earlier, O-ring 1412, which is incorporated in nozzle 1410, is made from a resilient material, such as a polymer, around its outer circumference to form a seal around the internal circumference of the rear portion of launch barrel 1415 to further improve the airtight connection.

Further, as shown in the exemplary embodiment in FIG. 12, launcher 1000 may include a cylinder guide 925 that guides the movement of cylinder 905 as the cylinder rotates from a vertical to a horizontal position, using spring 910 as an axis of rotation. As shown in FIGS. 9-13, the cylinder guide 925 may be a sloping roof that guides the forward end of the cylinder 905 as it moves between the horizontal and vertical positions.

Figure 13:
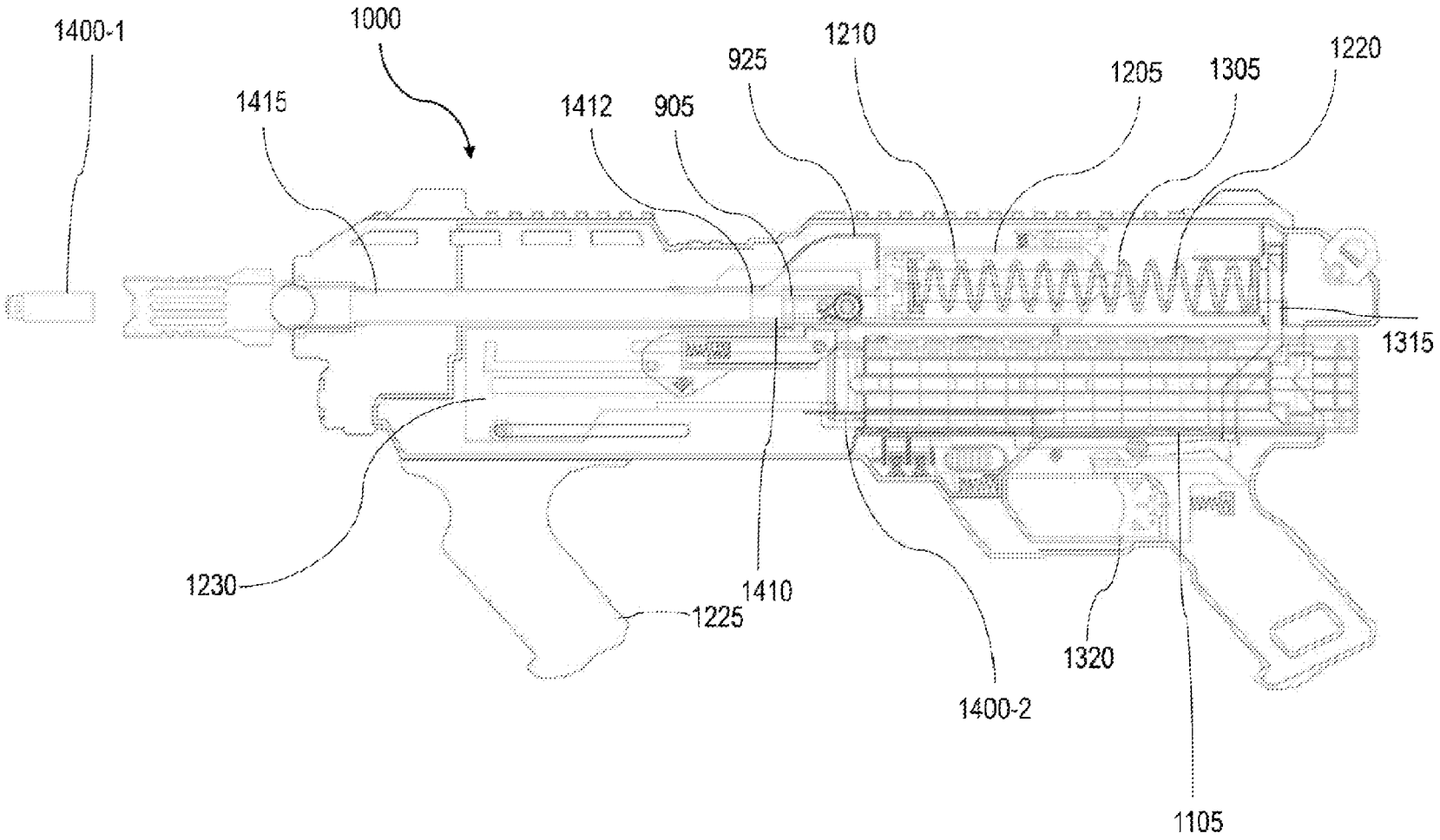
FIG. 13 is a schematic partial cross-sectional side view of a continuation from FIG. 12 of the projectile launcher of FIG. 9 being fired according to an exemplary embodiment of the present invention.

FIG. 13 is a schematic partial cross-sectional side view of a continuation from FIG. 12 of projectile launcher 1000 of FIG. 9 being fired according to an exemplary embodiment of the present invention. As shown in FIG. 13, trigger assembly 1320 is pulled back by a user, causing release of the plunger element 1210 from the spring-loaded plate 1315 and rapid forward movement of the plunger element 120 under force of the compression spring 1220, thereby expelling air from the air chamber 1407 through nozzle 1410 at high pressure. Nozzle 1410, via O-ring 1412, as shown above with respect to FIG. 12, has been inserted through cylinder 905 to form a seal around the internal circumference of the rear portion of launch barrel 1415 to provide an airtight connection. The air from nozzle 1410 impinges on dart 1400-1, which travels through launch barrel 1415 and out of the front of projectile launcher 1000. The airtight seal between launch barrel 1415 and nozzle 1410 ensures that none of the air directed from air chamber 1407 through nozzle 1410 escapes, thereby maximizing the force applied by the air guided through nozzle 1410 on dart 1400-1. As shown in the embodiment of FIG. 13, nozzle 1410 remains in cylinder 905 after air has been expelled and cylinder 905 remains in the horizontal orientation until the cocking cycle is repeated.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

The invention claimed is:

1. A toy launcher comprising:

a housing;

a storage cartridge configured for placement into an opening of the housing, with projectiles within the storage cartridge held in a first orientation in which a longitudinal axis of each projectile is perpendicular to a longitudinal axis of the housing;

a cocking slide movably attached to the housing between a first position and a second position;

a reciprocating frame operatively connected to the cocking slide;

a projectile housing pivotably attached to the toy launcher housing adjacent to the storage cartridge; and a feed lever operatively connected to the reciprocating frame, whereby movement of the cocking slide from the first position to the second position in a first priming step and then back to the first position in a second priming step causes the feed lever to move below a projectile from the storage cartridge and then push the projectile from the storage cartridge into the projectile housing, pivots the projectile housing so that the projectile is in a second orientation in which the longitudinal axis of the projectile is parallel to the longitudinal axis of the housing, and places the projectile in the second orientation at a firing position within the toy launcher.

2. The toy launcher of claim 1, wherein the operative connection between the feed lever and the reciprocating frame is configured so that the feed lever moves relative to the storage cartridge with a reciprocating movement of the reciprocating frame.

3. The toy launcher of claim 2, wherein the reciprocating feed lever comprises at least one first pin and at least one second pin disposed below the at least first pin, wherein the at least one second pin is fixed to the housing.

4. The toy launcher of claim 3, wherein the reciprocating frame comprises at least one first track and at least one second track disposed below the at least first track, wherein the at least one first pin of the reciprocating feed lever is slidably engaged within the at least first track of the reciprocating frame and the at least one second pin of the reciprocating feed lever is slidably engaged within the at least one second track of the reciprocating frame.

5. The toy launcher of claim 4, wherein the reciprocating feed lever comprises a retractable tip portion that is biased in an extended configuration.

6. The toy launcher of claim 5, wherein, upon a condition the cocking slide is in the first position before the first priming step, the retractable tip portion is pushed into a retracted configuration by the projectile which is a front-most projectile stored in the storage cartridge.

7. The toy launcher of claim 6, wherein, upon a condition the cocking slide is moved from the first position to the second position in the first priming step, the at least one first pin of the reciprocating lever is pushed backwards within the at least first track of the reciprocating frame so that the reciprocating lever is pivoted about the at least one second pin to a position below the storage cartridge, thereby releasing the retractable tip portion of the reciprocating lever into the extended configuration.

8. The toy launcher of claim 7, wherein, upon the condition the cocking slide is moved from the second position to the first position in the second priming step, the at least one first pin of the reciprocating lever is pulled forward within the at least first track of the reciprocating frame so that the reciprocating lever is pivoted about the at least one second pin and the retractable tip portion in the extended configuration is pushed into engagement with the front-most projectile of the storage cartridge, thereby pushing the front-most projectile into the projectile housing.

9. The toy launcher of claim 1, wherein the storage cartridge is spring-loaded.

10. The toy launcher of claim 1, further comprising a launch barrel.

11. The toy launcher of claim 10, further comprising an air piston assembly, the air piston assembly comprising:

a barrel operatively connected to the cocking slide;

a plunger element slidably disposed within the barrel;

an air nozzle disposed at a front portion of the barrel;

a push rod extending from the front portion of the barrel; and a compression spring that biases the plunger element within the barrel away from a back wall of the housing of the toy launcher.

12. The toy launcher of claim 11, wherein, upon a condition in which the cocking slide is moved from the first position to the second position in the first priming step, the barrel pushes the plunger element backwards to compress the compression spring against the back wall.

13. The toy launcher of claim 12, wherein, upon a condition in which the cocking slide is moved from the second position to the first position in the second priming step, the barrel is pulled forward while the plunger element is held in position by a coupling between the plunger element and the back wall, thereby pulling air through the air nozzle and into an internal air chamber formed by the plunger element and the barrel.

14. The toy launcher of claim 13, wherein, upon a condition in which the cocking slide is moved from the second position to the first position in the second priming step, the push rod reorients the projectile housing so that the projectile is placed in the second orientation.

15. The toy launcher of claim 14, wherein, upon a condition in which the cocking slide is moved from the second position to the first position in the second priming step, the air nozzle protrudes into the projectile housing to push the projectile into the firing position and the air nozzle forms an airtight seal with the launch barrel.

16. The toy launcher of claim 15, further comprising a trigger assembly.

17. The toy launcher of claim 16, wherein, upon actuation of the trigger assembly after the second priming step, the coupling between the plunger element and the back wall is released so that the compression spring pushes the plunger element forward to expel the air from the internal air chamber through the air nozzle, thereby firing the projectile from the toy launcher.

18. The toy launcher of claim 11, wherein the air piston assembly is substantially oval in cross-section.

19. A toy launcher comprising:

a housing;

a storage cartridge configured for placement into an opening of the housing, with projectiles within the storage cartridge held in a first orientation in which a longitudinal axis of each projectile is perpendicular to a longitudinal axis of the housing;

a cocking slide movably attached to the housing between a first position and a second position;

a reciprocating frame operatively connected to the cocking slide; and a feed lever operatively connected to the reciprocating frame, whereby movement of the cocking slide from the first position to the second position in a first priming step and then back to the first position in a second priming step causes the feed lever to move below a projectile from the storage cartridge and then push the projectile from the storage cartridge and into a second orientation in which the longitudinal axis of the projectile is parallel to the longitudinal axis of the housing, and places the projectile in the second orientation at a firing position within the toy launcher.

20. The toy launcher of claim 19, wherein the operative connection between the feed lever and the reciprocating frame is configured so that the feed lever moves relative to the storage cartridge with a reciprocating movement of the reciprocating frame.

21. The toy launcher of claim 19, wherein the reciprocating feed lever comprises at least one first pin and at least one second pin disposed below the at least first pin, wherein the at least one second pin is fixed to the housing.

22. The toy launcher of claim 21, wherein the reciprocating frame comprises at least one first track and at least one second track disposed below the at least first track, wherein the at least one first pin of the reciprocating feed lever is slidably engaged within the at least first track of the reciprocating frame and the at least one second pin of the reciprocating feed lever is slidably engaged within the at least one second track of the reciprocating frame.

23. The toy launcher of claim 22, wherein the reciprocating feed lever comprises a retractable tip portion that is biased in an extended configuration.

24. The toy launcher of claim 23, wherein, upon a condition the cocking slide is in the first position before the first priming step, the retractable tip portion is pushed into a retracted configuration by the projectile which is a front-most projectile stored in the storage cartridge.

25. The toy launcher of claim 24, wherein, upon a condition the cocking slide is moved from the first position to the second position in the first priming step, the at least one first pin of the reciprocating lever is pushed backwards within the at least first track of the reciprocating frame so that the reciprocating lever is pivoted about the at least one second pin to a position below the storage cartridge, thereby releasing the retractable tip portion of the reciprocating lever into the extended configuration.

26. The toy launcher of claim 25, wherein, upon a condition the cocking slide is moved from the second position to the first position, the at least one first pin of the reciprocating lever is pulled forward within the at least first track of the reciprocating frame so that the reciprocating lever is pivoted about the at least one second pin and the retractable tip portion in the extended configuration is pushed into engagement with the front-most projectile of the storage cartridge, thereby pushing the front-most projectile from the storage cartridge and into the second orientation.

27. The toy launcher of claim 26, further comprising a spring-loaded flap that pushes a tip portion of the front-most projectile downwards to pivot the front-most projectile into the second orientation while the reciprocating lever pushes the front-most projectile from the storage cartridge.

28. The toy launcher of claim 19, wherein the storage cartridge is spring-loaded.

29. The toy launcher of claim 19, further comprising a launch barrel.

30. The toy launcher of claim 29, further comprising an air piston assembly, the air piston assembly comprising:

- a barrel operatively connected to the cocking slide by the reciprocating frame;
- a plunger element slidably disposed within the barrel;
- an air nozzle disposed at the front of the barrel; and
- a compression spring that biases the plunger element within the barrel away from a back wall of the housing of the toy launcher.

31. The toy launcher of claim 30, wherein, upon a condition in which the cocking slide is moved from the first position to the second position in the first priming step, the barrel pushes the plunger element backwards to compress the compression spring against the back wall.

32. The toy launcher of claim 31, wherein, upon a condition in which the cocking slide is moved from the second position to the first position in the second priming step, the barrel is pulled forward while the plunger element is held in position by a coupling between the plunger element and the back wall, thereby pulling air through the air nozzle and into an internal air chamber formed by the plunger element and the barrel.

33. The toy launcher of claim 32, wherein, upon a condition in which the cocking slide is moved from the second position to the first position in the second priming step, the air nozzle pushes the projectile into the firing position and the air nozzle forms an airtight seal with the launch barrel.

34. The toy launcher of claim 33, further comprising a trigger assembly.

35. The toy launcher of claim 34, wherein, upon actuation of the trigger assembly after the second priming step, the coupling between the plunger element and the back wall is released so that the compression spring pushes the plunger element forward to expel the air from the internal air chamber through the air nozzle, thereby firing the projectile from the toy launcher.

36. The toy launcher of claim 30, wherein the air piston assembly is substantially oval in cross-section.

* * * * *